US006453494B1

(12) United States Patent
Koglin

(10) Patent No.: US 6,453,494 B1
(45) Date of Patent: Sep. 24, 2002

(54) MOVABLE BRIDGE CENTER LOCK

(76) Inventor: Terry L. Koglin, 6 Colonial Ave., Princeton Junction, NJ (US) 08550

( * ) Notice: Subject to any disclaimer, the term of this patent is extended or adjusted under 35 U.S.C. 154(b) by 0 days.

(21) Appl. No.: 09/533,961

(22) Filed: Mar. 23, 2000

(51) Int. Cl.[7] ..... E01D 15/08
(52) U.S. Cl. ..... 14/41; 14/35
(58) Field of Search ..... 403/230, 243, 403/187, 188; 52/167.3, 223.12; 14/35, 36, 37, 38, 39, 40, 41

(56) References Cited

U.S. PATENT DOCUMENTS

| | | | | | |
|---|---|---|---|---|---|
| 554,390 | A | | 2/1896 | Jennings | |
| 632,985 | A | | 9/1899 | Brayton | |
| 685,768 | A | | 11/1901 | Keller | |
| 689,856 | A | | 12/1901 | Cummings | |
| 1,157,449 | A | * | 10/1915 | Strauss | 14/38 |
| 1,633,565 | A | * | 6/1927 | Ash et al. | 14/36 |
| 1,646,340 | A | | 10/1927 | Ash | |
| 1,659,250 | A | | 2/1928 | Erdal | |
| 2,085,613 | A | * | 6/1937 | Stiles | 14/38 |
| 2,109,797 | A | * | 3/1938 | Lubin | 14/37 |
| 2,610,341 | A | | 9/1952 | Gilbert | 14/41 |
| 2,724,135 | A | * | 11/1955 | Hopkins | 14/36 |
| 2,759,430 | A | | 8/1956 | Kelsey | 104/131 |
| 4,065,218 | A | * | 12/1977 | Biggane | 403/71 |
| 4,738,033 | A | * | 4/1988 | Ferber et al. | 33/559 |
| 5,327,605 | A | | 7/1994 | Cragg | 14/41 |
| 6,092,953 | A | * | 7/2000 | Chaptal et al. | 403/12 |

OTHER PUBLICATIONS

Hool & Kinne, "Movable and Long–Span Steel Bridges," NY 1923–pp89–91.

Hovey, O. E., "Movable Bridges", vol. I Machinery, NY 1926–pp 105–108.

Hovey, O.E., "Movable Briadges", vol. II Machinery, NY 1927–pp 65–68.

FHWA, "Bridge Inspector's Manual for Movable Bridges," 1977 pp2–29 to 2–30.

Brinckerhoff, Parsons, "Bridge Inspection and Rehabilitation", NY 1993 pp 161–162.

Am. Assoc. of State Hwy and Trans., "AASHTO Movable Bridge Inspection, Evaluation and Maintenance Manual", Washington, D.C. 1998 pp2–124 to 2–126.

* cited by examiner

*Primary Examiner*—Robert E. Pezzuto
*Assistant Examiner*—Raymond Addie
(74) *Attorney, Agent, or Firm*—Watov & Kipnes, P.C.; Kenneth Watov

(57) ABSTRACT

The center locks of a bascule or other type of double leaf movable bridge are fitted on bearings mounted upon the main bridge girders, so that the center lock bars may be moved, when the bridge is in the lowered position, along a horizontal axis parallel to the axes of rotation of the leaves of the bridge, effecting a shear connection at the meeting point of the two leaves of the structure so that, when the bridge is in the lowered position and the center lock bars are engaged rigidly with respective rotating sockets, the tips of the leaves at a vertical lateral plane containing the center locks are forced to deflect equally while the center locks accommodate longitudinal movement and rotational deflection of the protruding ends of the two leaves via components that are permanently engaged, optionally including capacity of independent rotation of the main bridge members on axes parallel to the longitudinal axis of the bridge.

50 Claims, 26 Drawing Sheets

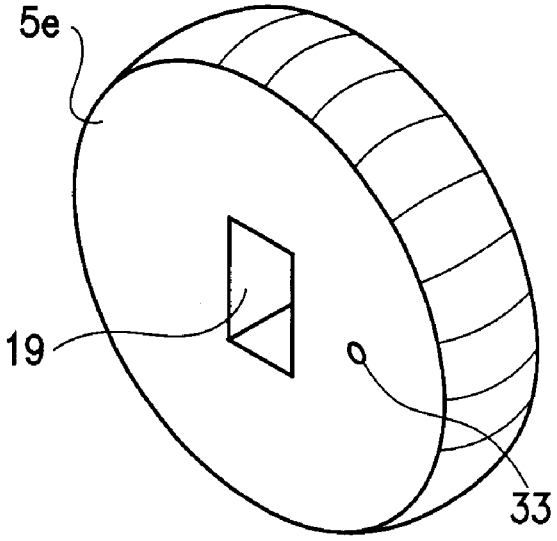
FIG. 26
FIG. 27
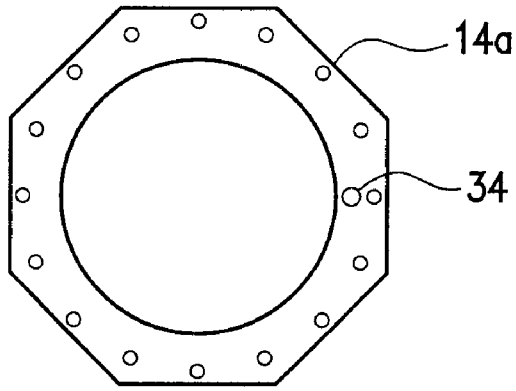

MOVABLE BRIDGE CENTER LOCK

FIELD OF THE INVENTION

This invention relates generally to movable bridges, and more particularly to double to leaf bridges, stabilizing devices for movable bridges, and center locks for movable bridges.

BACKGROUND OF THE INVENTION

Movable bridges have been used for centuries to provide land vehicle or personnel passage across a body of water while allowing vessels to navigate on the waterway past the location of the bridge. The most common types of movable bridges include the swing bridge, which rotates about a vertical axis to remove its obstruction from the waterway, the vertical lift bridge which has a span over the waterway that can be lifted up sufficiently to clear a vessel navigating the waterway, and the bascule bridge that rotates about a horizontal axis at a right angle to the bridge or parallel to the waterway, swinging up and away from the navigation channel to clear it for vessels.

Movable bridges have generally been stabilized by the use of locking devices. A double leaf bridge has a pair of movable bridge sections, or leaves, which meet at or near the center of a navigation channel over which the bridge forms a removable roadway crossing, one leaf projecting from one side of the navigation channel, and the other leaf projecting from the other side of the channel. The typical bridge leaves open by rotating about axes which are at right angles to the bridge. The double leaf bridge usually has a mating pair of center lock devices rigidly attached to each of the bridge trusses or girders on each leaf. These devices, when the bridge is in the lowered position, engage to form a shear connection between the two leaves.

Prior art in this field has been limited in utility because of the tendency of the mating components of the center locks to wear due to contamination of the surfaces which slide while under live load and other forces.

Movable bridges consisting of roadway decks and minor structural members supported on bridge trusses or girders are required at many locations where highways or railways are required to cross navigable streams at a low elevation, where vessels navigating the stream cannot pass under the bridge but must have the bridge section over the navigable channel relocated temporarily to allow for the required vertical clearance. The double leaf bascule type of bridge is frequently used due to its economy of construction, ease and rapidity of operation, and minimal obstruction of the navigation channel. Most modem double leaf bascule bridges consist of two cantilever spans on opposite sides of a navigable waterway, arranged so that the spans rotate downward, driven by operating machinery, bringing their tips, or toe ends, to near proximity at the center of the channel to provide a passageway for vehicular traffic. A few double leaf swing bridges have been built which have features similar to double leaf bascule bridges, but which rotate about a vertical axis instead of a horizontal one to open the waterway for navigation and to reposition the bridge for carrying land highway traffic.

The weight, or dead load, of the extended leaves of the double leaf bridge and the traffic, or live load, upon the leaves is usually carried back to the piers in cantilever fashion. Center locks are deployed to link the tips of the two leaves together when closed, so that traffic load at the midportion of the span is shared by the leaves, and so that both leaf tips deflect approximately the same when the bridge is carrying traffic load and reacting to the effects of temperature changes, thus minimizing the discontinuity of the roadway surfaces at the meeting point of the two leaves, reducing or eliminating the bump experienced by a vehicle passing from one leaf to the other.

Typical center locks for a double leaf movable bridge are of one of three types: (1) a bolt that is thrust by mechanical means, from the end of each girder or truss on one leaf into a socket attached to the end of the corresponding truss or girder on the other leaf; (2) A pincer type mechanism, which may consist of male or female movable jaws, on one leaf which reaches out and grasps an extension on the other leaf; or (3) mating rigid male-female jaws mounted on the projecting ends of the bridge girders or trusses of each bridge leaf which interlock as the bridge is closed. The center lock components of these prior art devices suffer from impact and wear forces, resulting largely from deflection when under the influence of traffic loads.

The typical configuration of traditional center locks places high bearing pressure on components that move relative to each other when the bridge is carrying traffic and are exposed to contamination by road dirt, dust in the air, rain water and other contaminants. The result of the combination of high bearing pressure and contamination is rapid wear of the components, so that clearances increase, adding impact loads to the forces on the lock components, causing further increases in the rate of deterioration and allowing substantial misalignment of the two leaves at their meeting point. After a time, due to this deterioration, other bridge components, such as the span operating machinery and live load shoes, suffer more rapid degradation because of the worn-out condition of the center locks. Various schemes have rearranged the components of center locks, such as rotating them so that the lock bars are at right angles to the main bridge girders or trusses, without eliminating the problem of wear of components exposed to contamination.

SUMMARY OF THE INVENTION

This invention, by separating the components that move under live load conditions from the components that are exposed to contamination, provides movable bridges with center locks that are much more durable than those heretofore employed. This invention can be applied equally as well to double leaf bascule bridges of the simple trunnion type, rolling lift type, heel trunnion type, most other variations of double leaf bascule bridges, including those which incorporate multiple parallel sets of leaves, with multiple leaves on the same side of the navigation channel either connected or unconnected, and other types of movable bridges such as double swing bridges which have two separate leaves which meet over the navigation channel.

In a movable bridge supported on piers, having one or more pairs of opposing mating movable bridge leaf sections each of which includes a deck and main and minor support members and bearings upon which said movable bridge is mounted on said piers and live load bearings which contact said movable bridge when in position to carry traffic, the improvement invention includes a set of center locks engaging parallel to the axes of rotation of the movable bridge, driven by thrusting mechanisms at each mating pair of main bridge support members, thereby separately accommodating engagement and deflection of the bridge leaf sections.

BRIEF DESCRIPTION OF THE DRAWINGS

Various embodiments of the invention are described below with reference to the accompanying drawings, in which like terms are identified by the same reference designation, with subdividing letter suffixes to indicate different embodiments of the same component.

FIG. 26 shows a pictorial view of rotating socket 5*e*.

FIG. 27 shows a detail view of the flange 14*a* with hole 34.

DETAILED DESCRIPTION OF THE INVENTION

Figure 1:
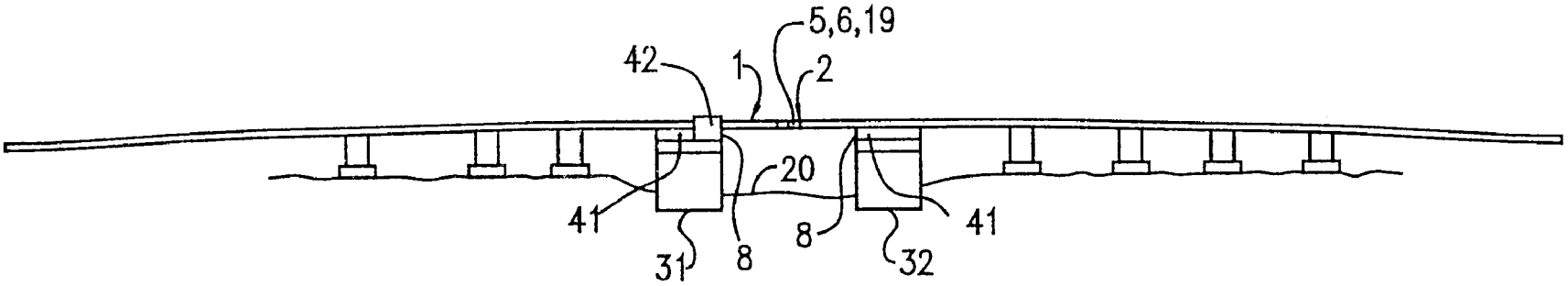
FIG. 1 is a general side elevational view of a typical double leaf bascule bridge including an embodiment of the invention.

FIG. 1, providing a general elevation of the typical double leaf bascule bridge, shows the relationship of the near leaf 1 supported by bearing 41 on pier 31 to the far leaf 2 supported by bearing 41 on pier 32 and the navigation channel 20, with the live load bearings 8 stabilizing the near leaf 1 and the far leaf 2 in the position shown, to carry traffic. Also, the operator's house 42 is shown on pier 31.

Figure 2:
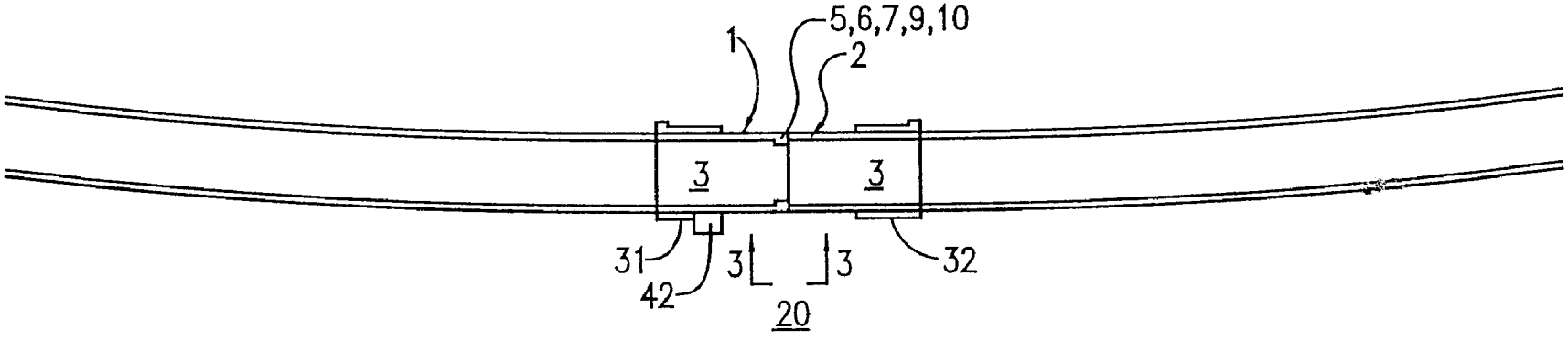
FIG. 2 is a top plan view of a typical double leaf bascule bridge showing the general arrangement of the invention as applied to the double leaf bascule bridge of FIG. 1.

From FIG. 2 looking down on the bridge, it will be seen that the typical double leaf bascule bridge consists of one near leaf 1 and another far leaf 2. The deck, 3, which supports traffic, is at the top of the leaves 1 and 2 so that the cantilevered extensions of the near leaf 1 and far leaf 2 reach proximity over the navigation channel 20. As the overwhelming number of double leaf bascule bridges far outnumbers the number of double swing bridges, the application of the invention to the double leaf bascule form of movable bridge is shown in considerable detail in this specification, although the basic elements of the invention apply equally to other double types of movable bridges with separate leaves that connect above the navigation channel 20 including double swing bridges.

Figure 2A:
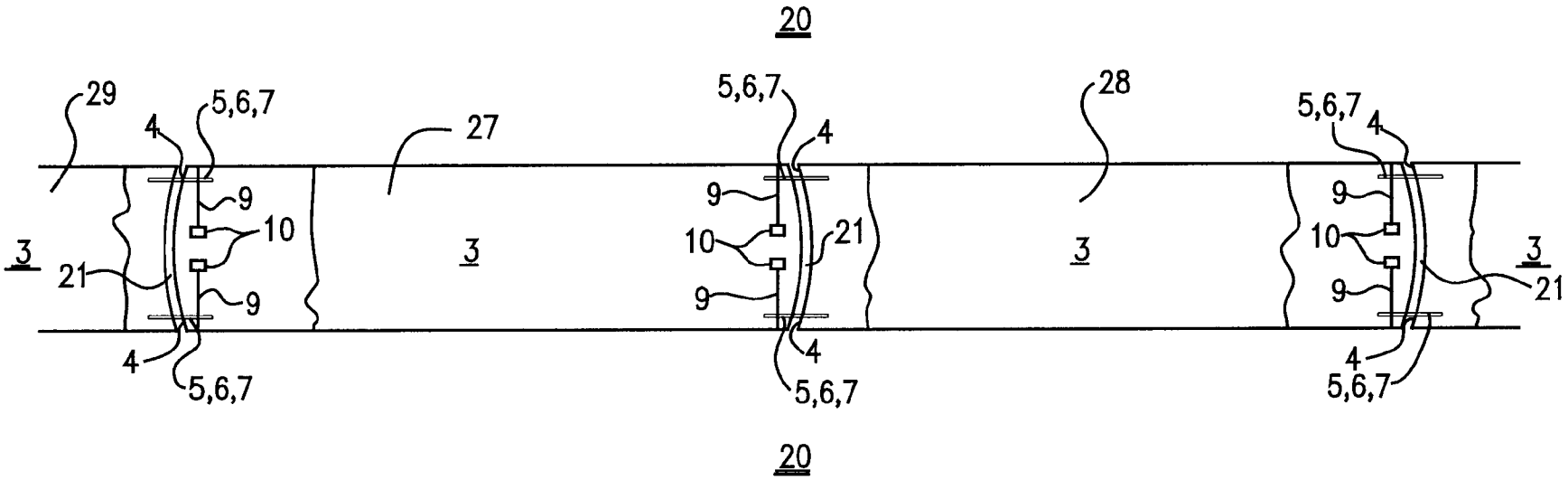
FIG. 2A is a top plan view of a typical double swing bridge, showing the general arrangement of the invention as applied to a double swing bridge.

From FIG. 2A, looking down on a typical double swing bridge, the application of the invention to this type of movable bridge can be seen. The lock bars 9 and their thrusting mechanisms 10 are mounted on the main span 27, and the rotating sockets 5 and sliding blocks 6 are mounted, via the guides 7, on the secondary span 28. Additional locks are located between these spans and the approach spans 29. The rotating sockets 5, sliding blocks 6 and guides 7 are mounted on the approach spans 29, and the lockbars 9 are mounted at the adjacent portions of the main span 27 and the secondary span 28. The rotating sockets 5, sliding blocks 6 and guides 7 are mounted on the trusses or girders 4 in such a manner as to allow them to be folded inward to clear the apparatus on the opposing span end or toe 21, allowing the respective spans 27 and 28 to rotate freely when opening and closing.

Figure 3A:
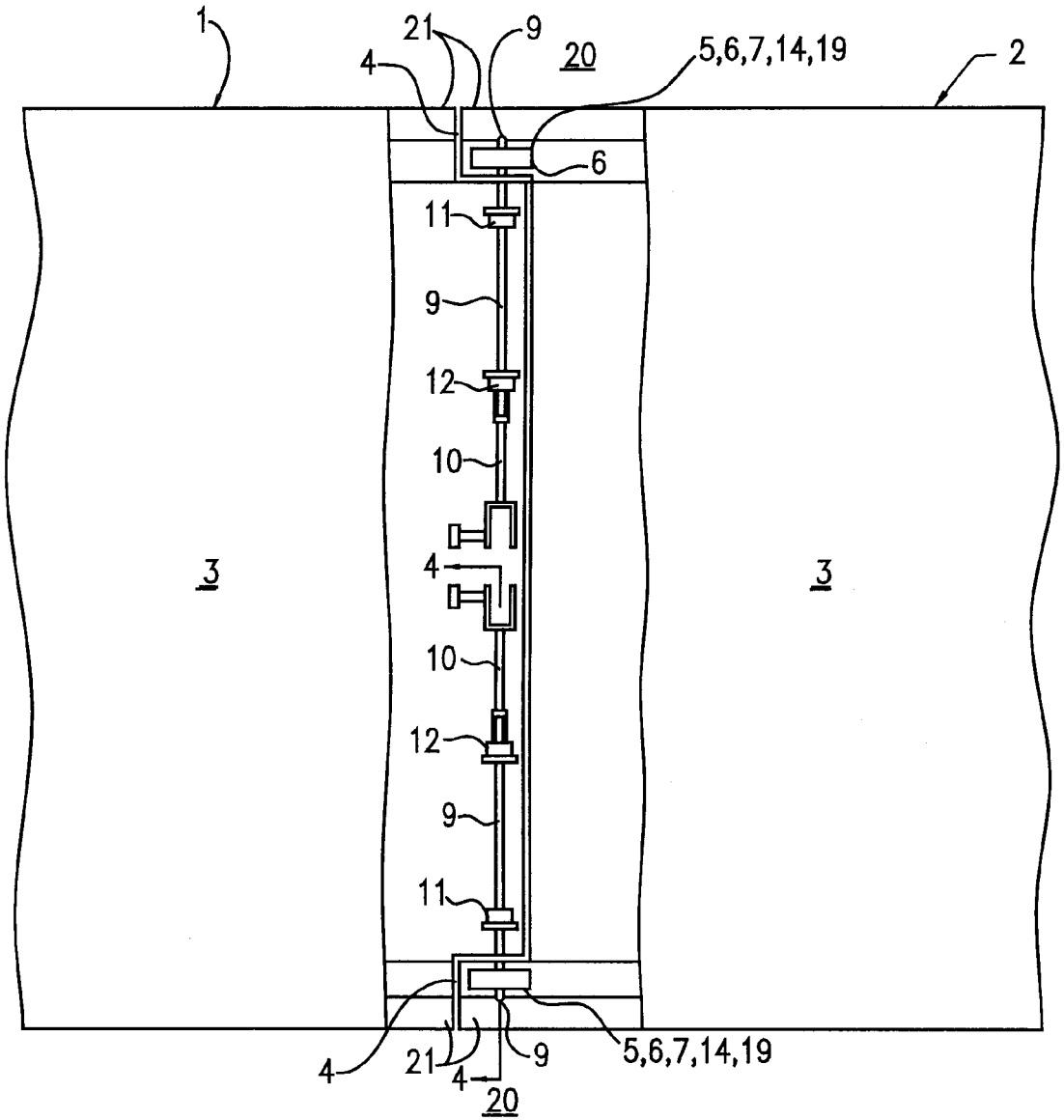
FIG. 3A is a top plan view of a structural portion of a typical double leaf bascule bridge with the deck partially removed showing the relative positioning of the components of the invention.
Figure 3B:
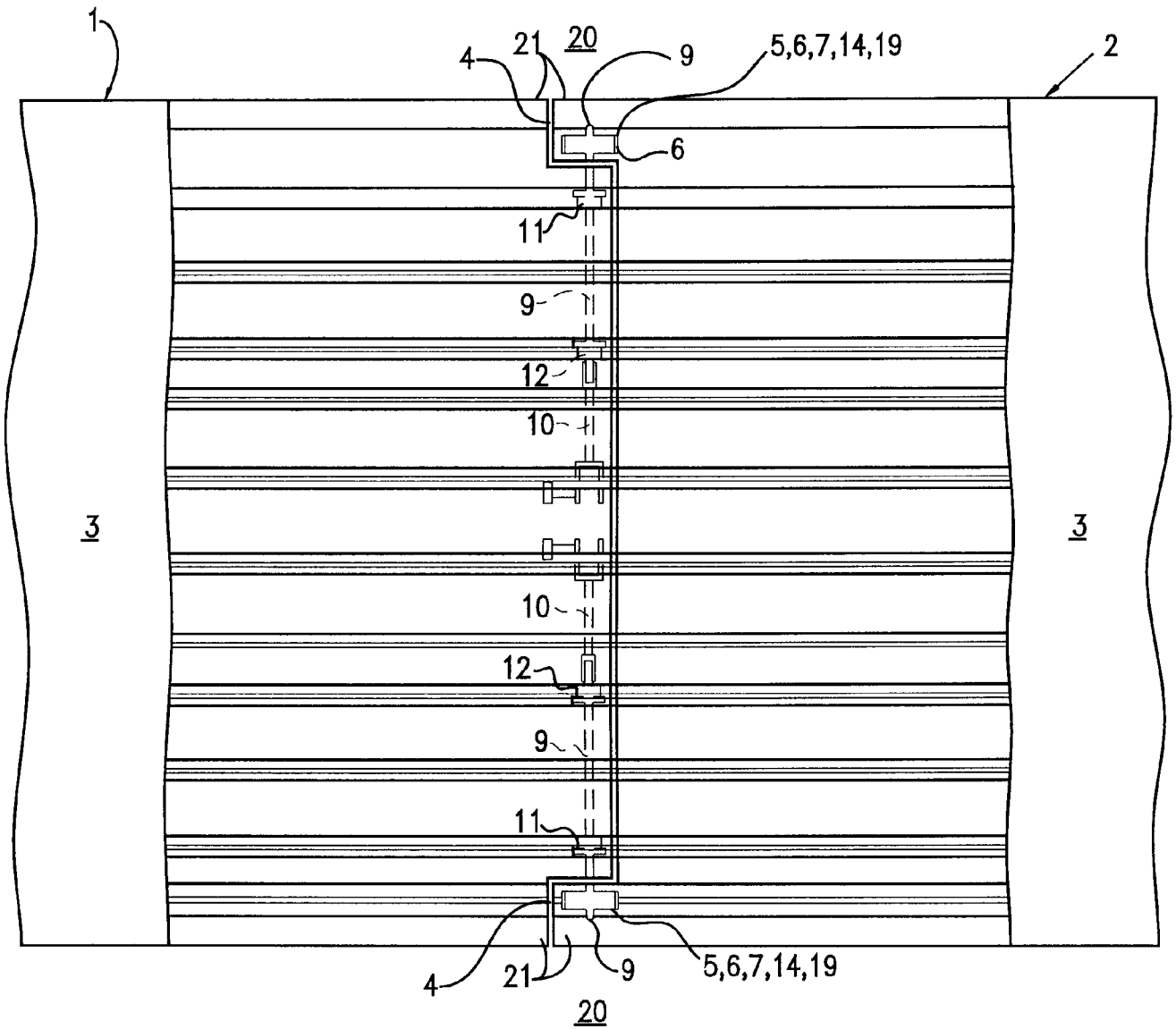
FIG. 3B is a top plan view of a structural portion of a typical double leaf bascule bridge with the deck partially removed showing the relative positioning of the components of the invention in relation to several of the minor structural members of the bridge.
Figure 4:
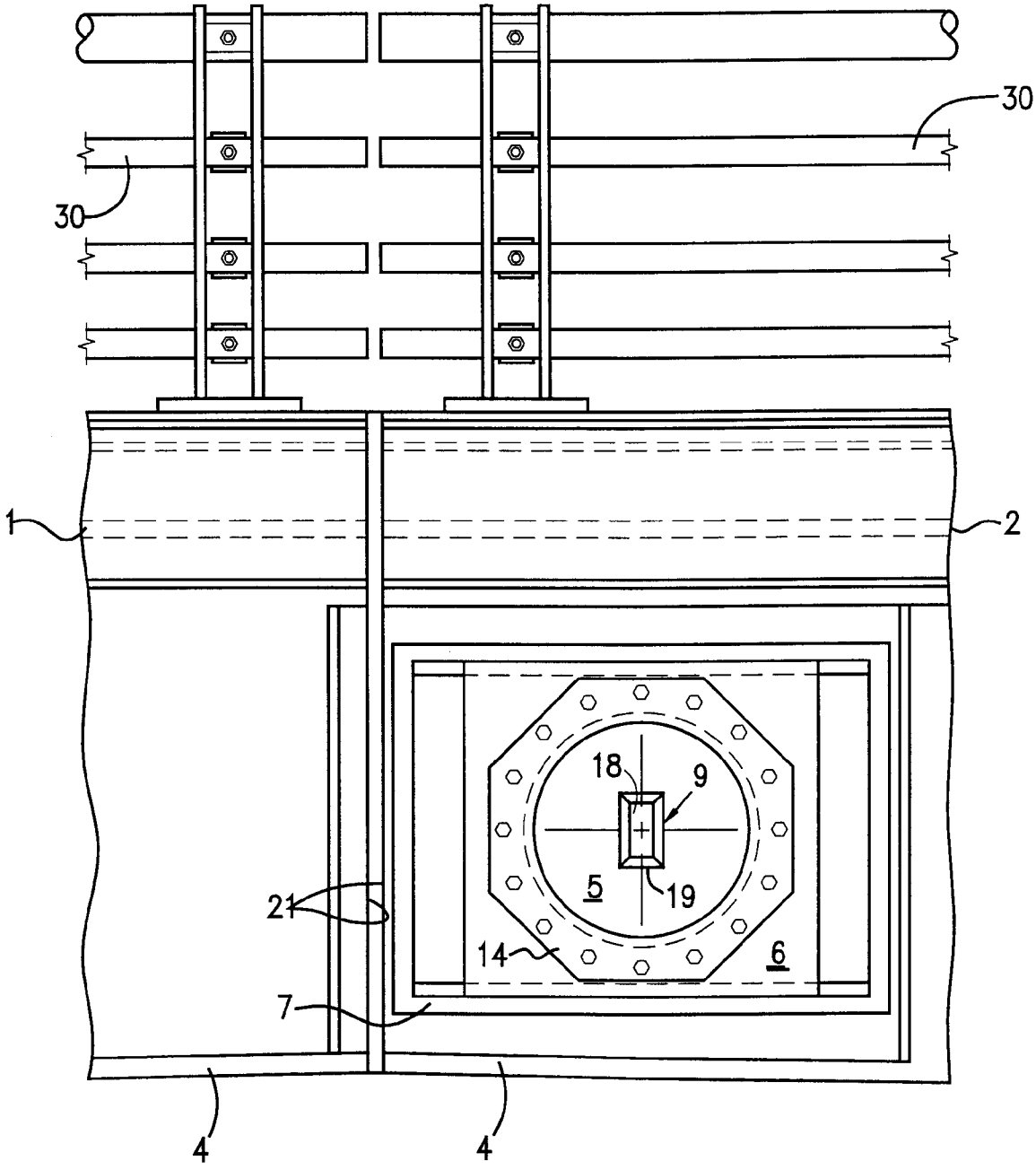
FIG. 4 is a side elevational view taken along 3—3 of FIG. 2, looking at a portion of a double leaf bascule bridge, showing the installation of the invention.
Figure 5:
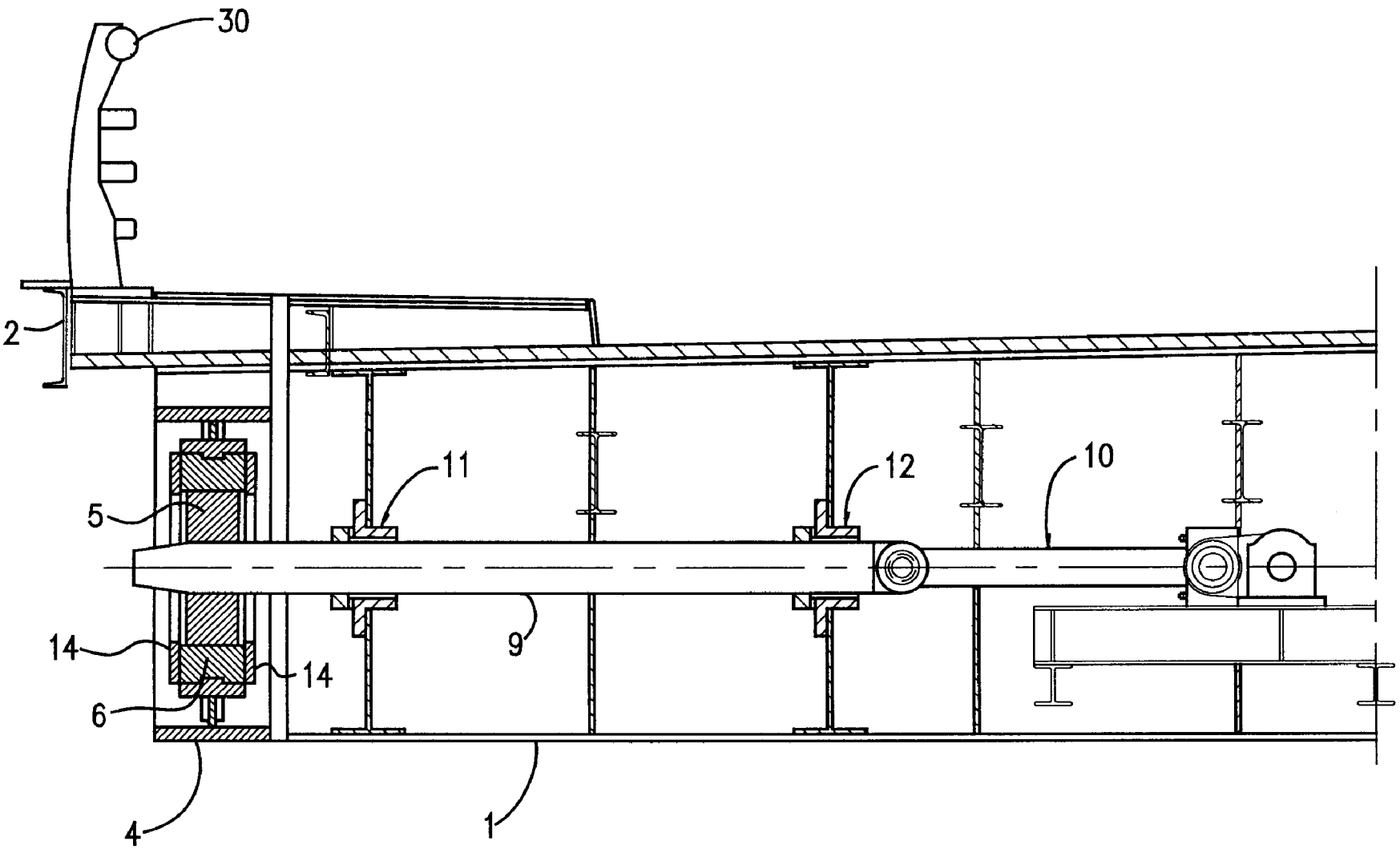
FIG. 5 is a partial cross section, taken along 4—4 of FIG. 3A, of a portion of a double leaf bascule bridge in the area of the center locks, looking along a main truss or girder 4 of the bridge, showing the installation of the invention with one form of components, including rotating socket 5 and sliding block 6.

From FIG. 3A and FIG. 3B looking down at the partially exposed bridge, it will be seen that the span end or toe 21 of the far leaf 2 is at the end of the girder or truss 4, in which is permanently mounted the rotating socket 5 with hole 19, supported on a linear bearing formed from a sliding block 6 permanently mounted to and movably connected via guides 7 fixed to the girder 4, under the deck, 3. With reference also to FIGS. 4 and 5, the mating surfaces of the rotating socket 5 and sliding block 6 are formed of cylinders, external and internal respectively, with sufficient clearance between these components so that free rotation of the socket 5 within the block 6 is allowed within the limits necessary to accommodate initial misalignment of the bridge leaves 1,2 and deflection of the leaves 1,2 due to live load and temperature differences, but the rotating socket 5 cannot be detached from the sliding block 6, and the flanges 14 prevent excessive movement of the socket 5 within the block 6 beyond that which is desired. Greater details of the aforesaid components are given below.

As seen in FIG. 4, the end portion 18 of lock bar 9 engages the rotating socket 5 which is mounted in the sliding block 6 and restrained therein by the flanges 14. The sliding block 6 is supported by the guides 7, mounted on the main bridge member consisting of truss or girder 4 and minor bridge members 30 of the near leaf 1 and the far leaf 2. As seen in FIG. 4, the guides 7 have sufficient clearance to the sliding blocks 6 to allow free longitudinal movement of the sliding blocks 6 within the guides 7 mounted on the trusses or girders 4 to allow for longitudinal differences of position of the toe ends 21 of the near leaf 1 and far leaf 2 due to temperature and live load differences, as well as possible misalignment of the near and far leaves 1 and 2 which may occur as they are being positioned to carry traffic, so that the lock bar 9 with tapered leading portion 18 can be inserted into a hole 19 of the rotating socket 5.

As seen in FIG. 5, looking toward the end of the near leaf 1 of the bridge, on which near leaf 1 is mounted, the lock bar 9 is of non-circular prismatic cross section through the portion in contact with the externally cylindrical rotating socket 5 in the internally cylindrical sliding block 6. When engaged, said lockbar 9 is mounted with its axis lateral to the roadway. The lockbar 9 is engaged and disengaged by a thrusting mechanism 10. The lock bar 9 is held in position parallel to the axes of rotation of the leaves 1 and 2 by front bar guide 11 and rear bar guide 12, both mounted on the near leaf 1. After passing through the rotating socket 5 the leading end of the lock bar 9 may, to provide additional strength and stability, engage an optional fixed socket 22 (not shown) on the near leaf 1.

Figure 6:
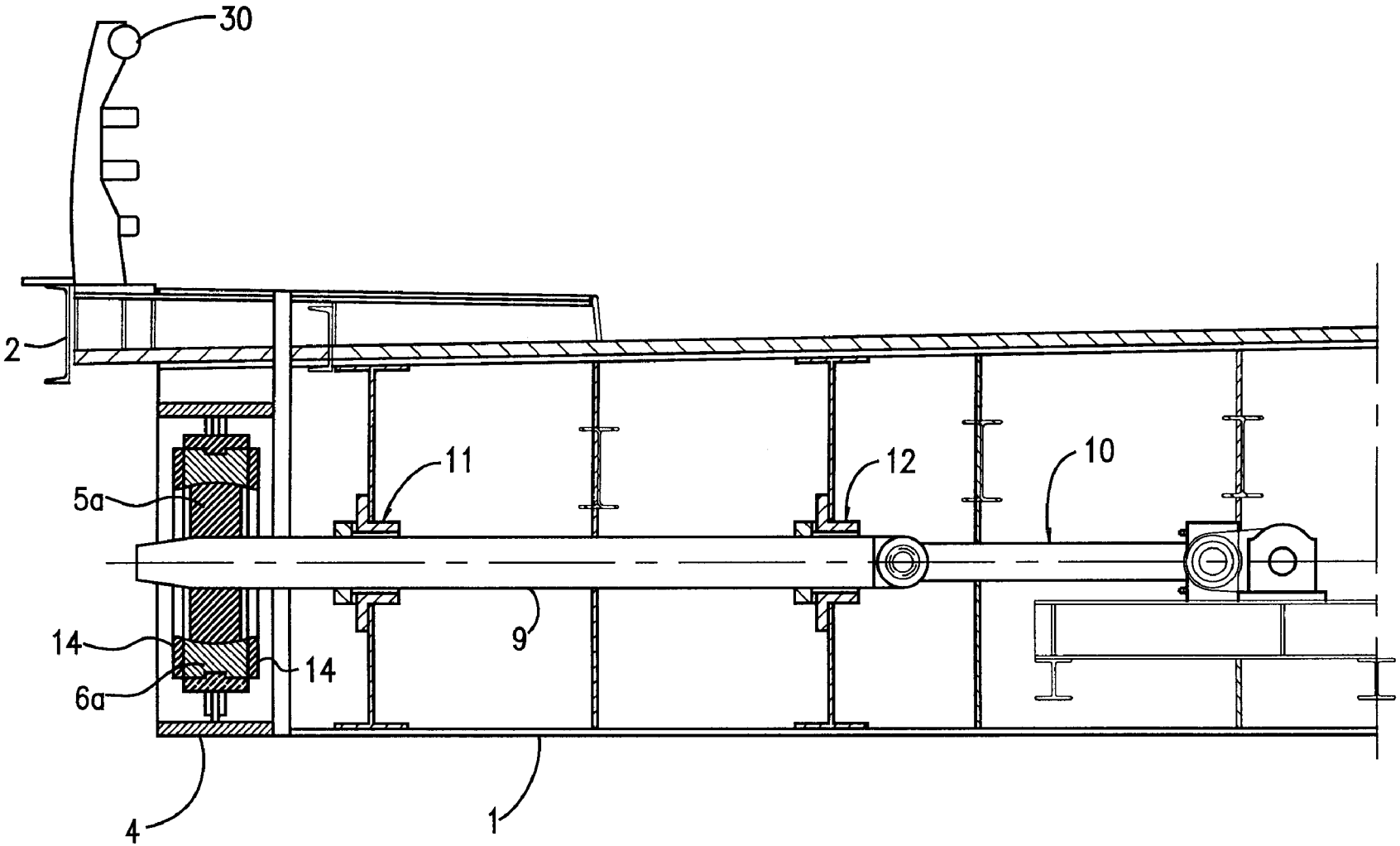
FIG. 6 is a partial cross section, taken along 4—4 of FIG. 3A, of a portion of a double leaf bascule bridge in the area of the center locks, looking along a main truss or girder 4 of the bridge, showing the installation of the invention with an alternative form of components, including rotating socket 5*a* and sliding block 6*a*.

As seen in FIG. 6, looking toward the end of the near leaf 1 of the bridge, the optional truncated externally spherical rotating socket 5*a* mates with the optional internally spherical sliding block 6*a*.

Figure 7:
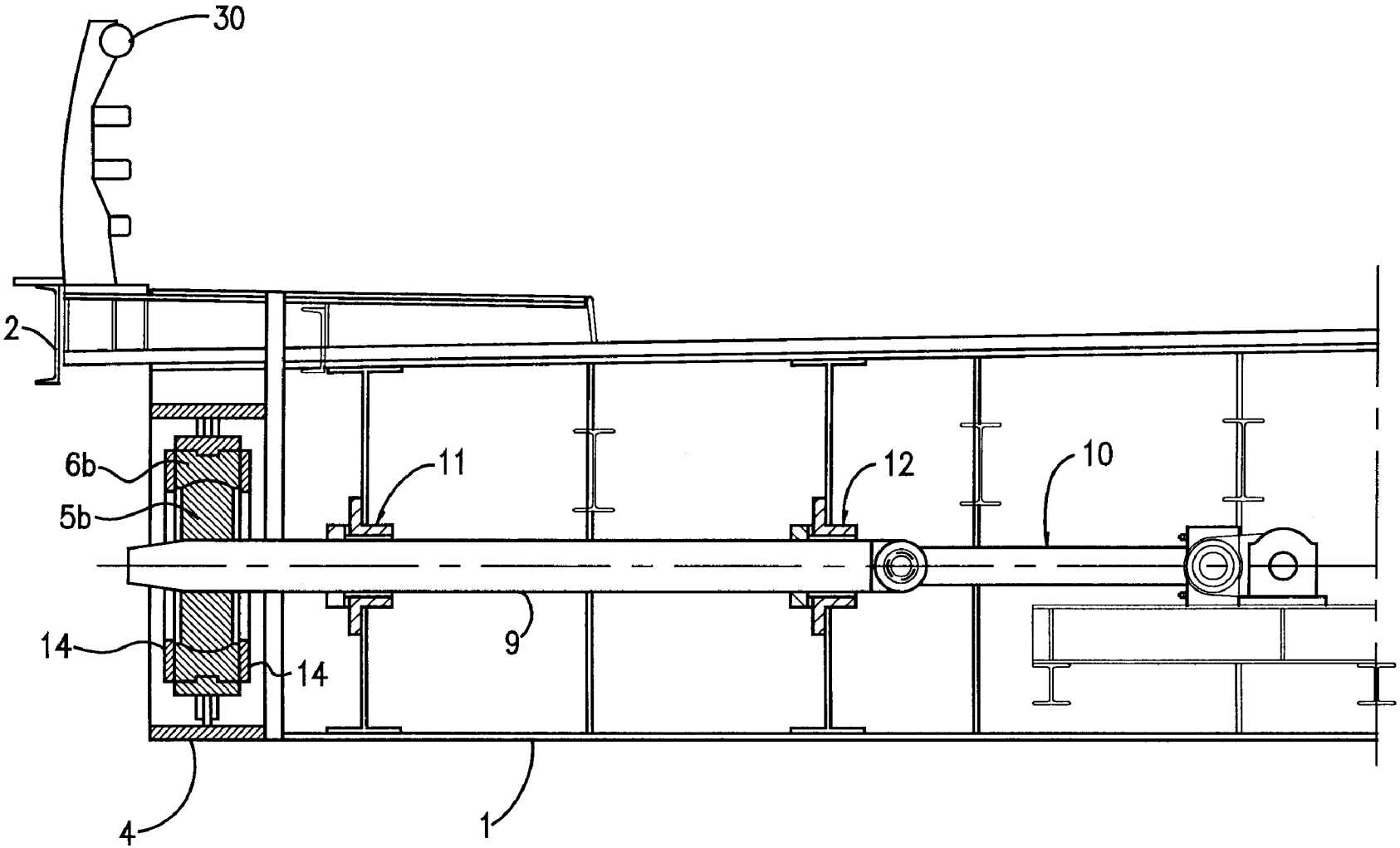
FIG. 7 is a partial cross section, taken along 4—4 of FIG. 3A, of a portion of a double leaf bascule bridge in the area of the center locks, looking along a main truss or girder 4 of the bridge, showing the installation of the invention with another alternative form of components, including rotating socket 5*b* and sliding block 6*b*.

As seen in FIG. 7, looking toward the end of the near leaf 1 of the bridge, the optional doubly truncated externally spherical rotating socket 5*b* mates with the optional truncated internally spherical sliding block 6*b*.

Figure 7A:
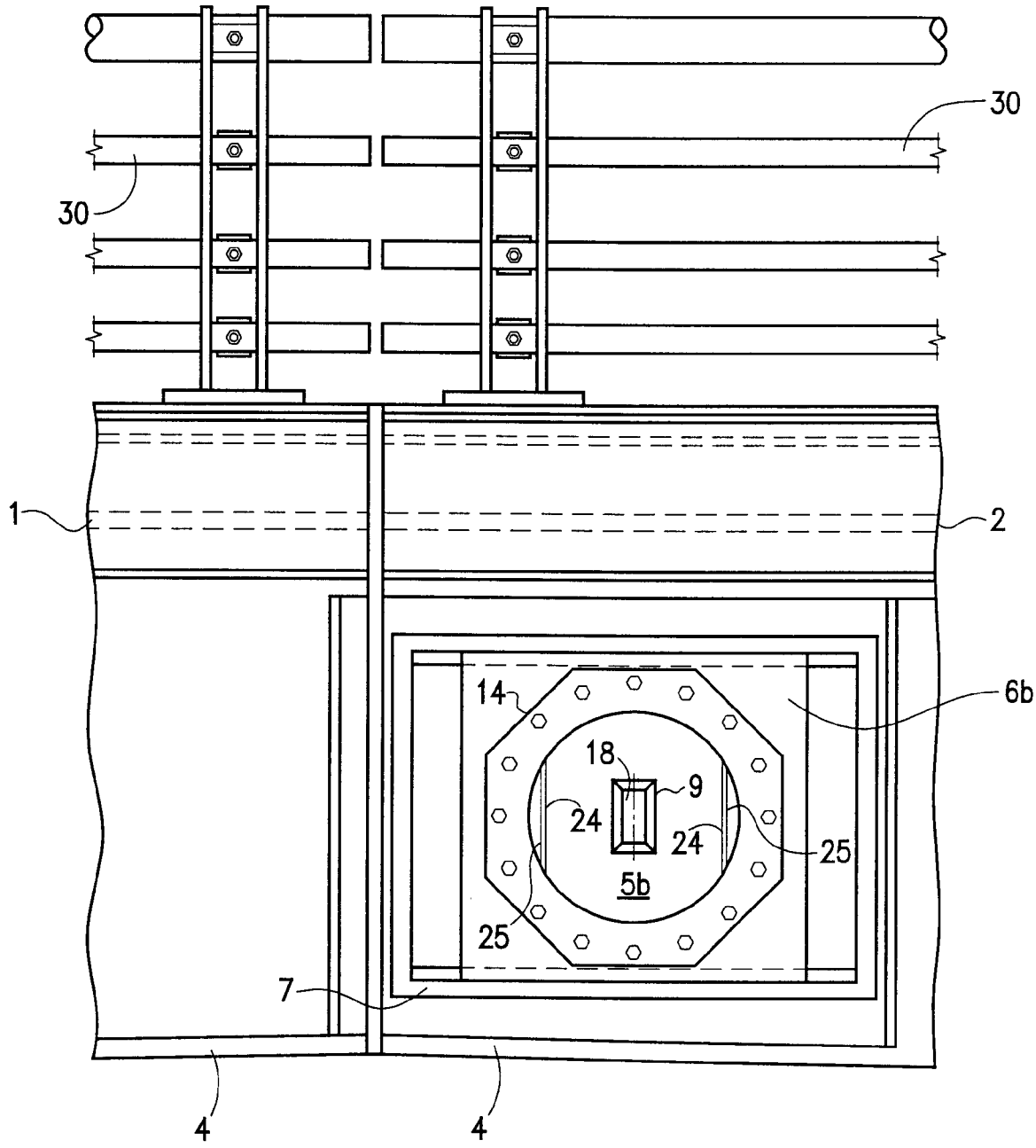
FIG. 7A is a side elevational view taken along 3—3 of FIG. 2, showing the relationship of rotating socket 5*b* and sliding block 6*b*.

As seen in FIG. 7A looking at the side of the end of the far leaf 2 of the bridge, the truncations 24 of the optional doubly truncated externally spherical rotating socket 5*b* when combined with the truncations 25 of the truncated internally spherical sliding block 6*b* prevent excessive rotation of the rotating socket 5*b* within the sliding block 6*b* so that, when disengaged from the lockbar 9, the rotating socket 5*b* does not become misaligned with the lockbar 9 to such an extent that it cannot be reengaged with the lockbar 9.

Figure 8:
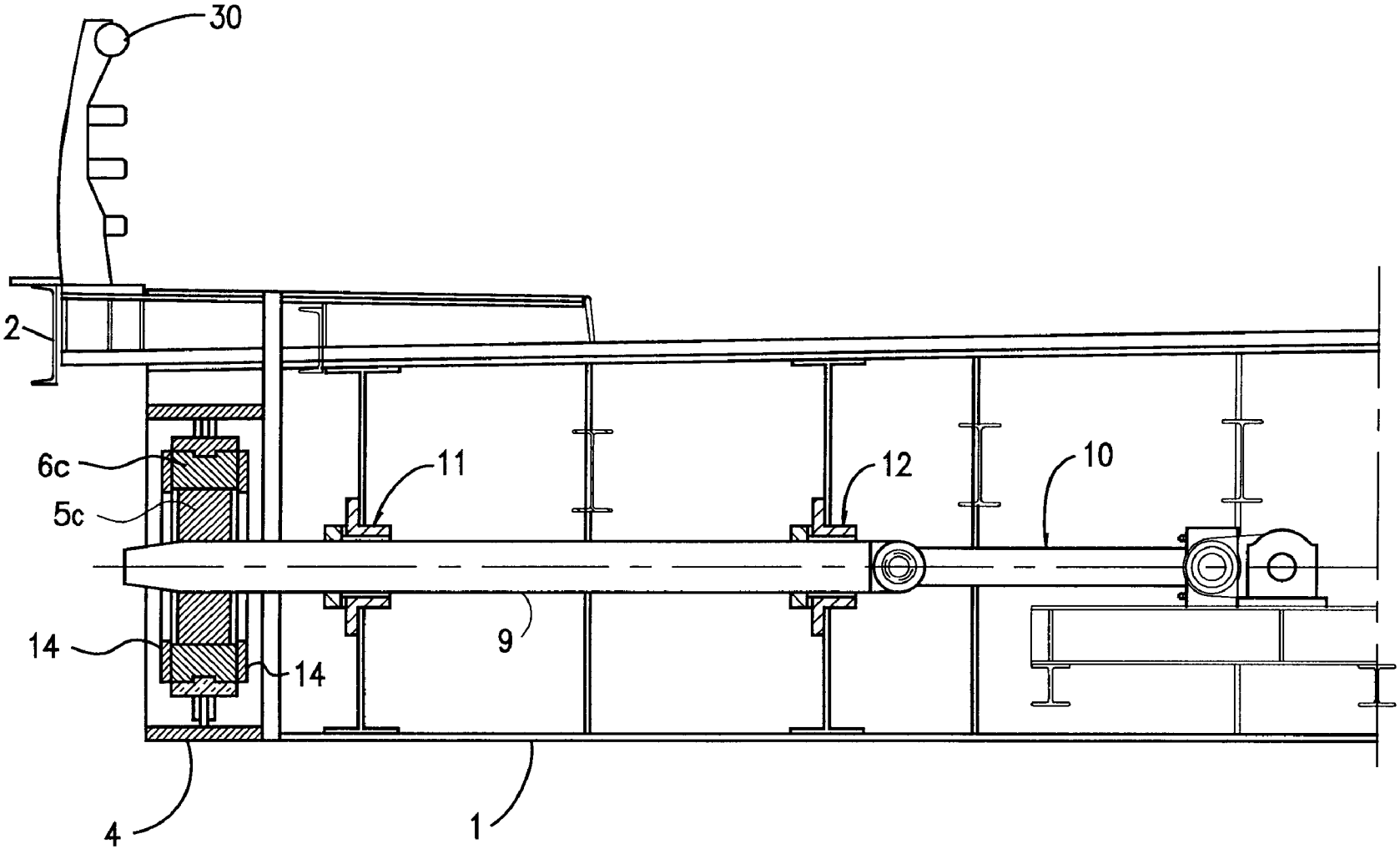
FIG. 8 is a partial cross section, taken along 4—4 of FIG. 3A, of a portion of a double leaf bascule bridge in the area of the center locks, looking along a main truss or girder 4 of the bridge, showing the installation of the invention with an alternative form of components, including rotating socket 5*c* and sliding block 6*c*.

As seen in FIG. 8, looking toward the end of the near leaf 1 of the bridge, the optional truncated externally cylindrical rotating socket 5*c* mates with the optional truncated internally cylindrical sliding block 6*c*.

Figure 8A:
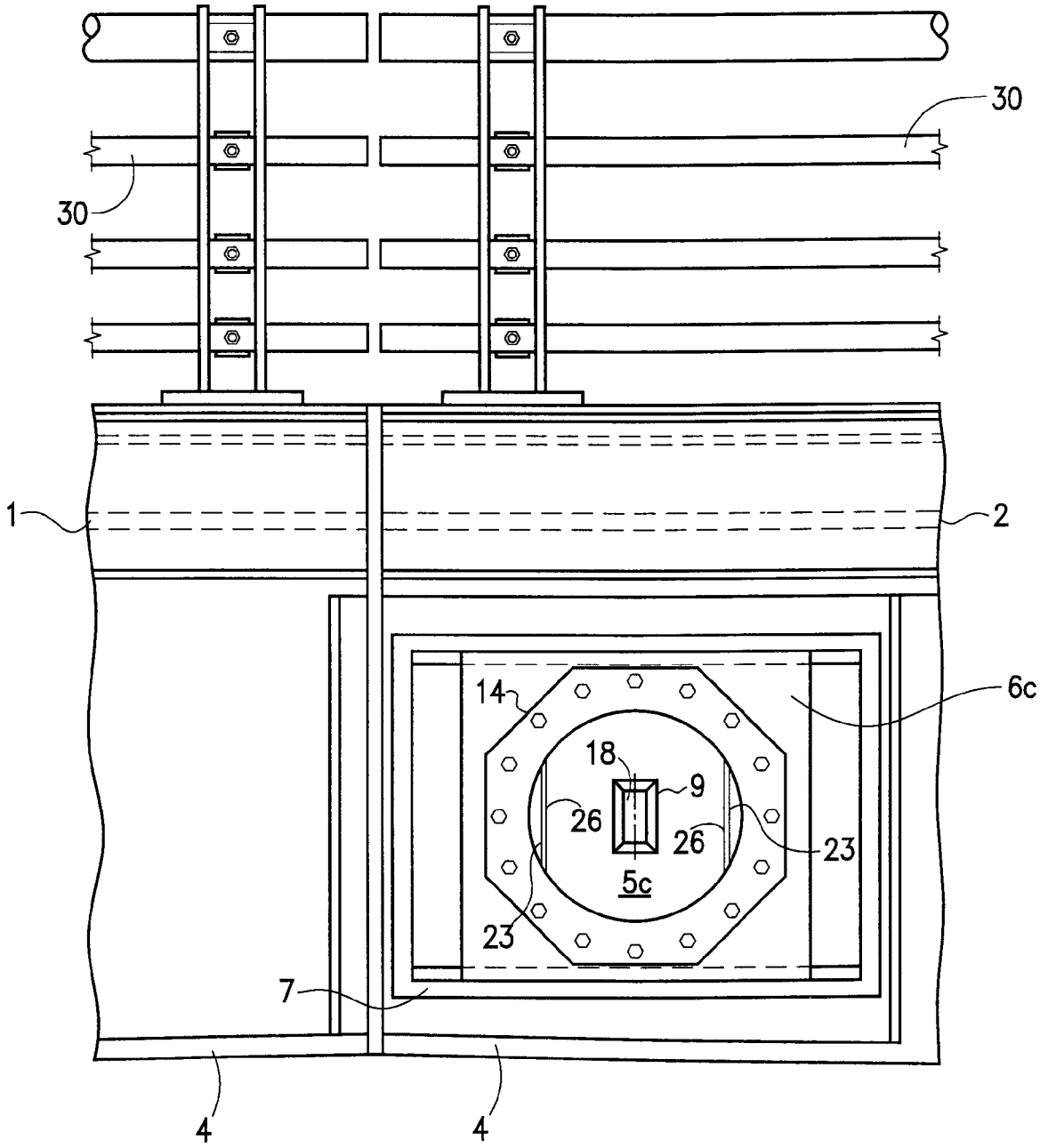
FIG. 8A is a side elevational view taken along 3—3 of FIG. 2, showing the relationship of rotating socket 5*c* and sliding block 6*c*.

As seen in FIG. 8A looking at the side of the end of the far leaf 2 of the bridge, the truncations 26 of the optional truncated externally cylindrical rotating socket 5*c*, when combined with the truncations 23 of the truncated internally cylindrical sliding block 6*c* prevent excessive rotation of the rotating socket 5*c* within the sliding block 6*c* so that, when disengaged from the lockbar 9, the rotating socket 5*c* does not become misaligned with the lockbar 9 to such an extent that it cannot be reengaged with the lockbar 9.

Figure 9:
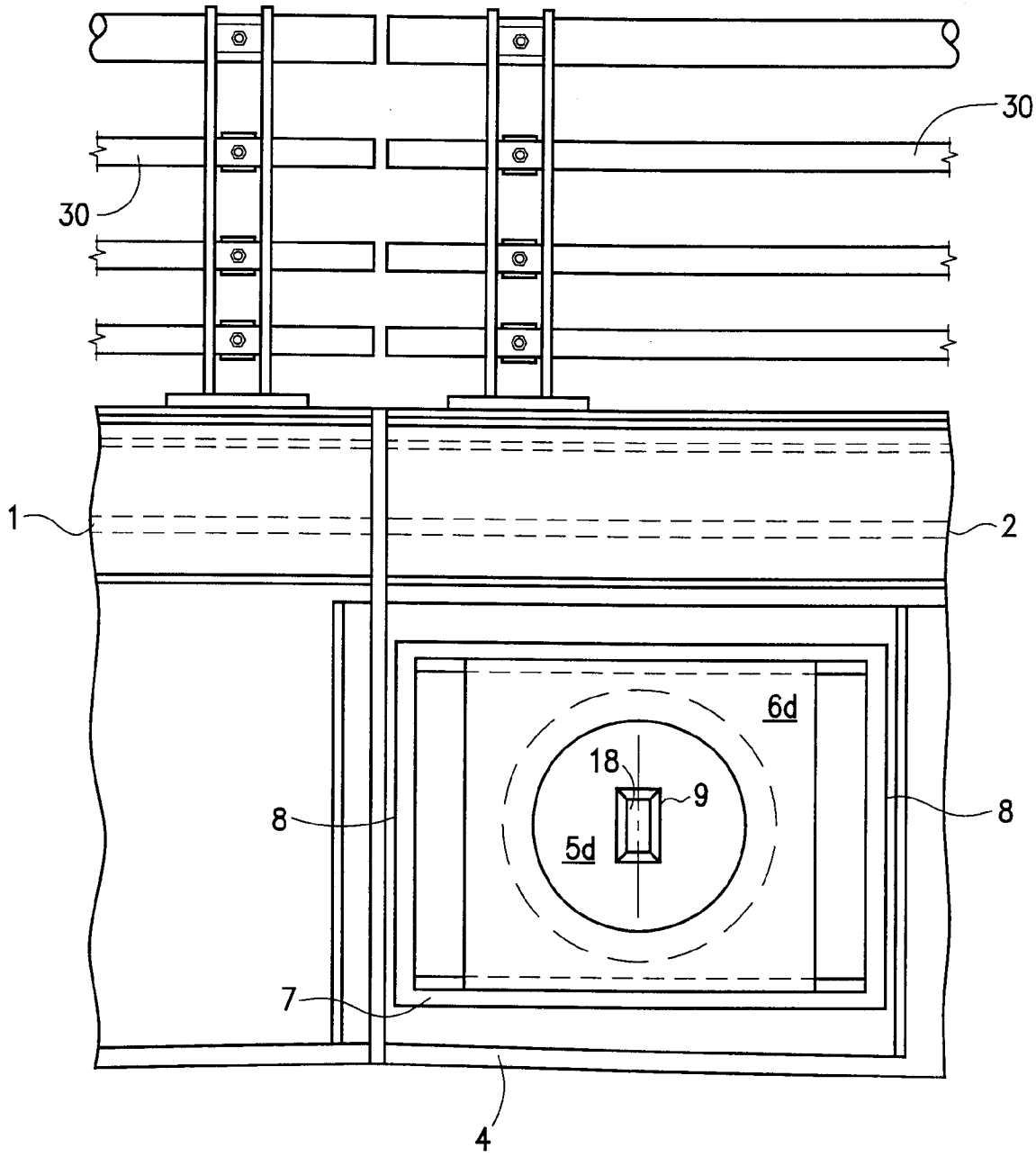
FIG. 9 is a partial cross section, taken along 3—3 of FIG. 2, of a portion of a double leaf bascule bridge in the area of the center locks, showing the installation of the invention with another alternative form of components including rotating socket 5*d* and sliding block 6*d*.

As seen in FIG. 9, looking toward the end of the far leaf 2 of the bridge, the optional stepped externally cylindrical rotating socket 5*d* mates with the optional stepped internally cylindrical sliding block 6*d*.

Figure 9A:
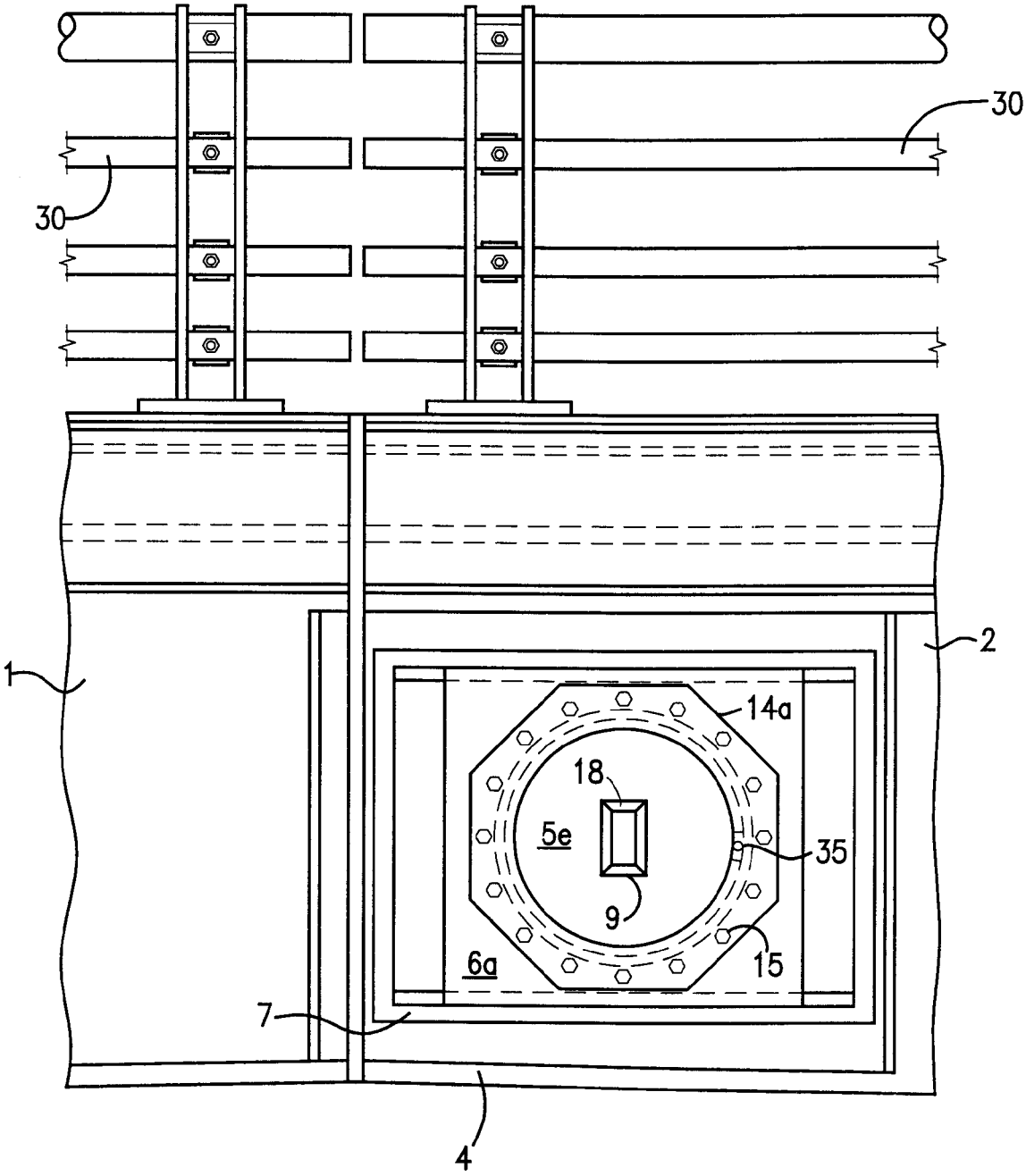
FIG. 9A is a partial cross section, taken along 3—3 of FIG. 2, of a portion of a double leaf bascule bridge in the area of the center locks, showing the installation of the invention with another alternative form of components, including rotating socket 5*e* mating with sliding block 6*a*.

As seen in FIG. 9A, looking toward the end of the far leaf 2 of the bridge, the optional externally spherical rotating socket 5*e* mates with the internally spherical sliding block 6*a*. The movement of the rotating socket 5*e* is restrained by the combination of flange 14*a* and bolt 35, so that the socket 5*e*, when disengaged from lockbar 9, does not become excessively misaligned. Rotating socket 5*e*, with large hole 33, is shown in pictorial view in FIG. 26. The flange 14*a* is shown, with hole 34 mating with bolt 35 (FIG. 27).

With further reference to FIG. 9A, it shows the assembly of rotating socket 5*e* in sliding block 6*a*, and restraining bolt 35, for yet another embodiment of the invention. FIG. 26 shows the truncated externally spherical rotating socket 5*e*, with hole 33. FIG. 27 shows flange 14*a* with hole 34 for bolt 35, which fits tightly at hole 34 but loosely at hole 33 in rotating socket 5*e*, allowing limited movement of rotating socket 5*e* within sliding block 6*a* so that lateral and other local deflections of the trusses or girders 4 can be accommodated when the lock assembly is engaged, and preventing excessive misalignment of the rotating socket 5*e* with the lockbar 9 when disengaged, so that reengagement of the components is facilitated.

Figure 10:
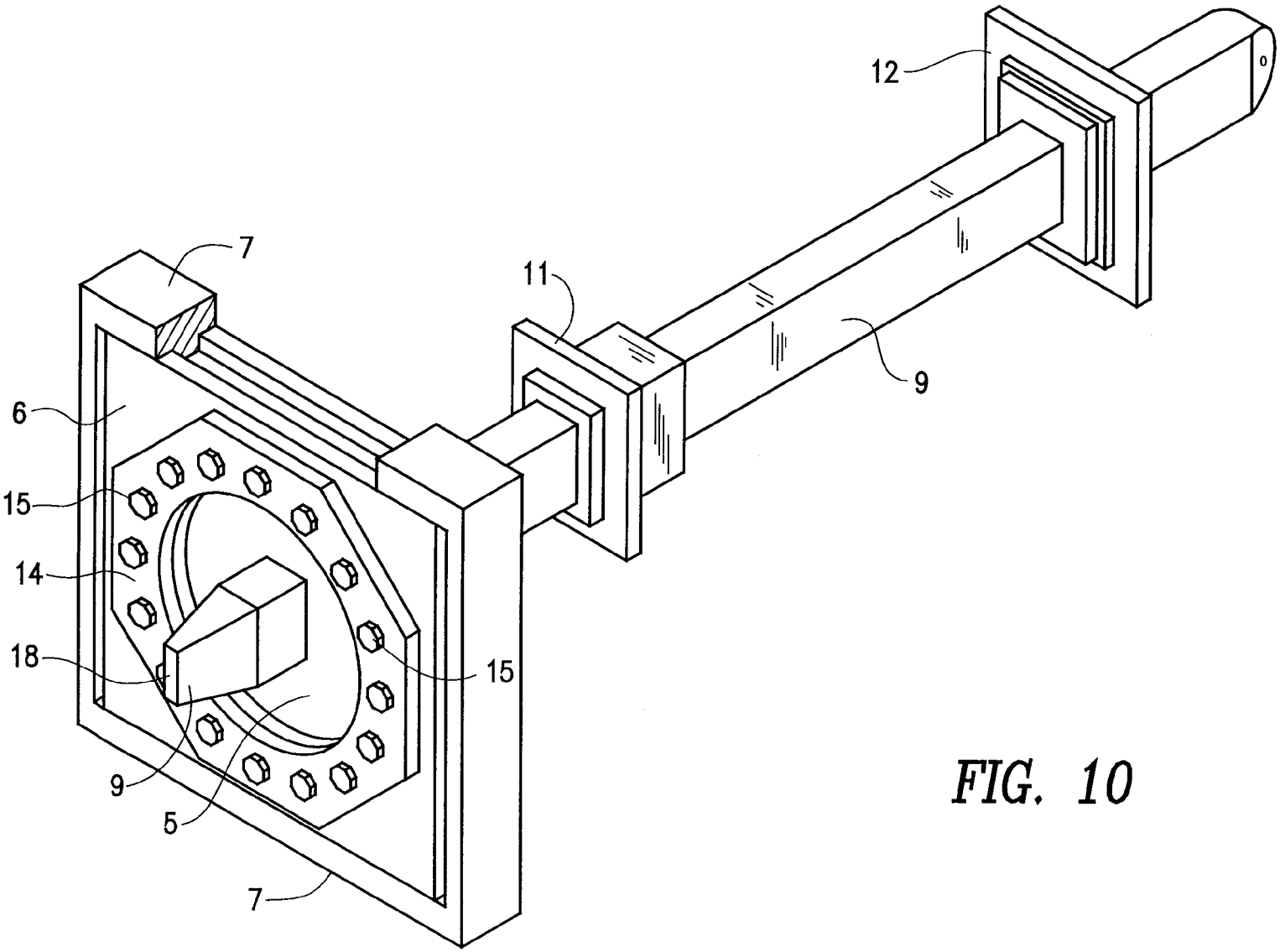
FIG. 10 is a pictorial view showing the interrelation of the lockbar 9, the rotating socket 5 and the sliding block 6 of the invention with the components engaged.

In the pictorial view of FIG. 10 the relationship is shown between the front bar guide 11, the rear bar guide 12, the rotating socket 5 and the sliding block 6, with the lock bar 9 engaged in the rotating socket 5. Also seen is the relationship between the guide 7 and the sliding block 6.

Figure 11:
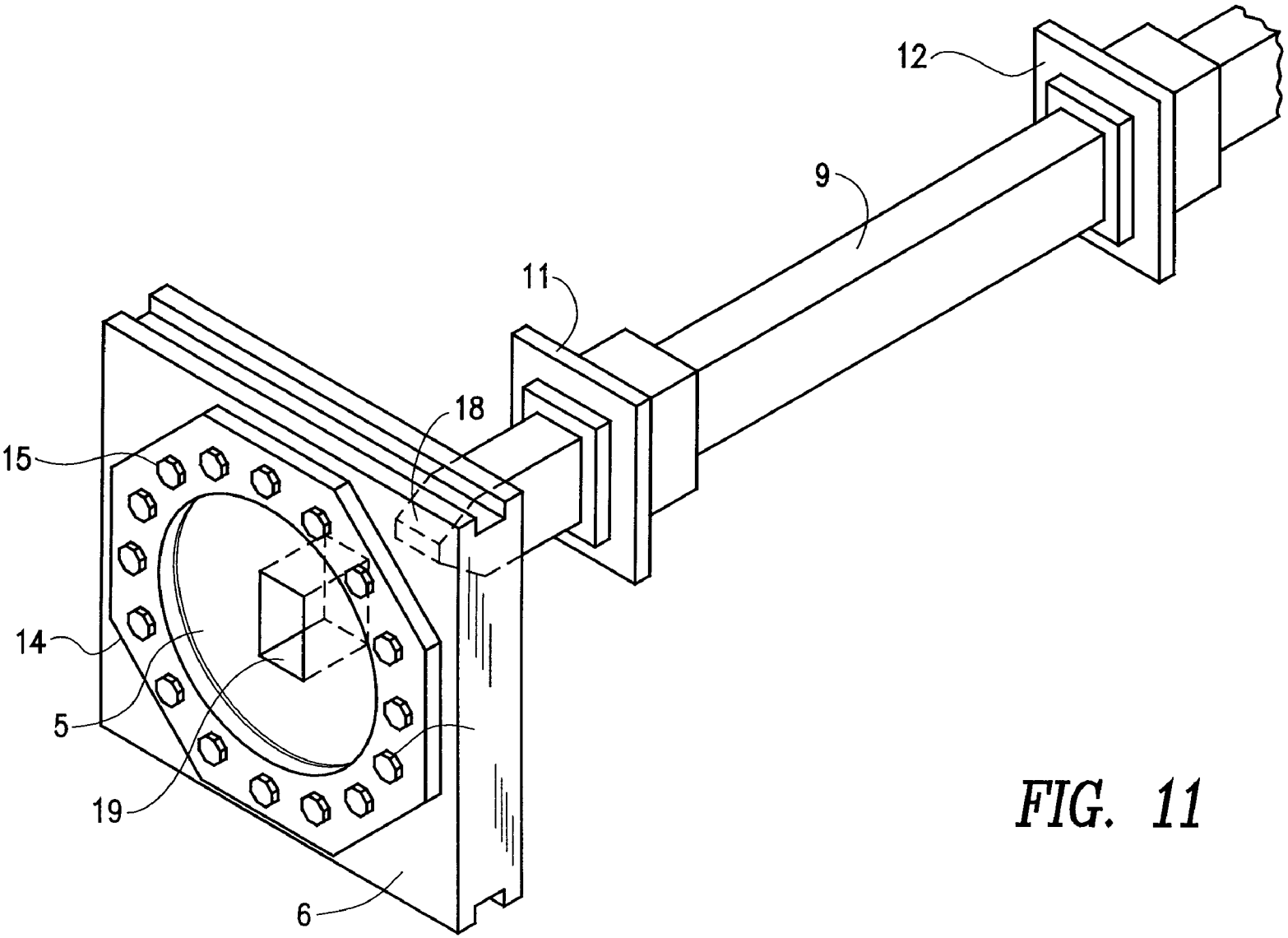
FIG. 11 is a pictorial view showing the interrelation of the lockbar 9, the rotating socket 5 and the sliding block 6 of the invention with the components disengaged.

In the pictorial view of FIG. 11 the relationship is shown between front bar guide 11, the rear bar guide 12, the rotating socket 5 and the sliding block 6 with the lock bar 9 disengaged from the rotating socket 5.

Figure 12:
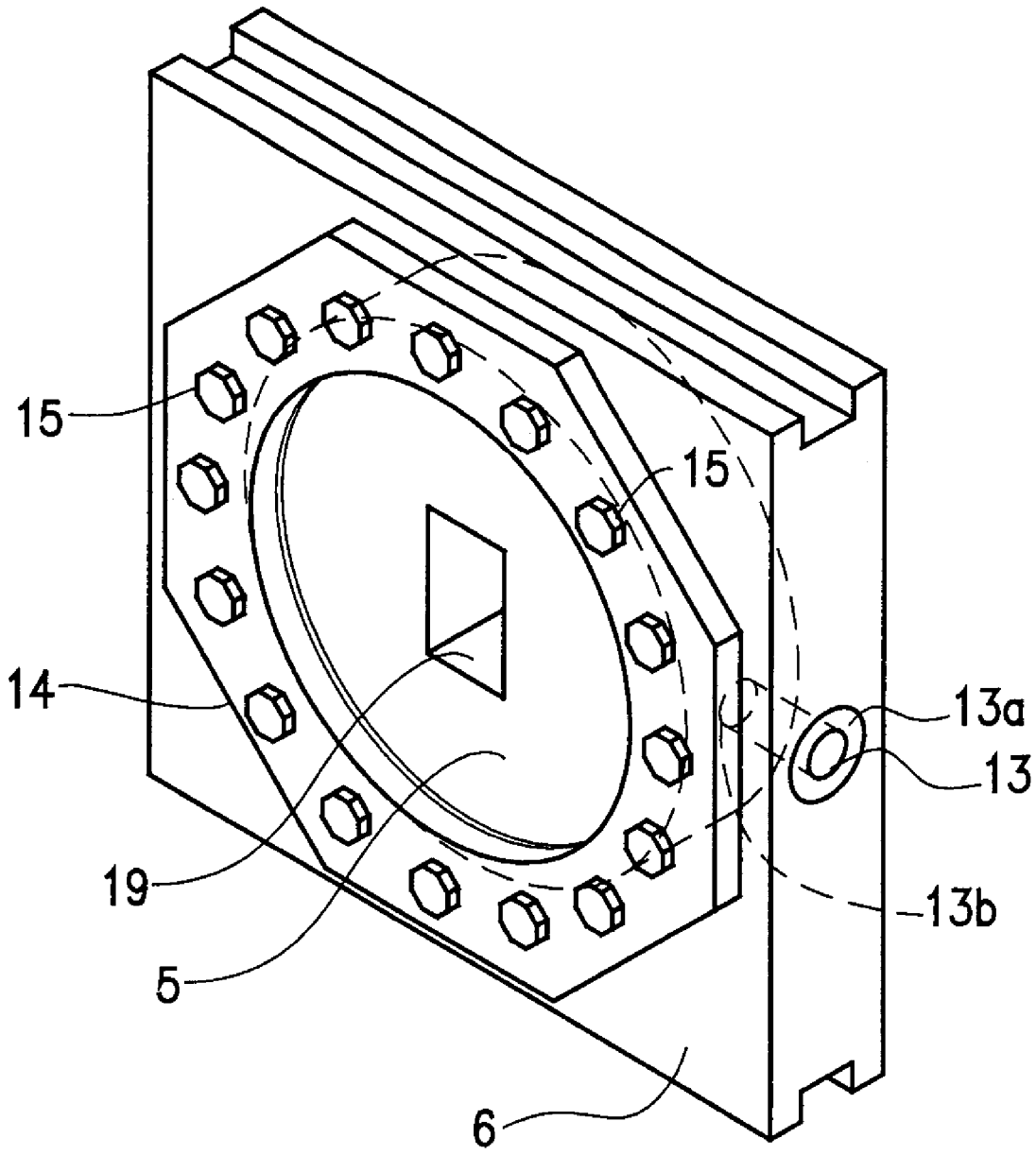
FIG. 12 is a pictorial view showing an optional means of locating the components, by means of a radially mounted pin 13 fitted to the rotating socket 5 and the sliding block 6.

FIG. 12 is a pictorial view of an assembly including an optional pin 13, for limiting the movement of the rotating socket 5. As shown, the radially inserted pin 13 fits tightly in hole 13*b* in the socket 5 and loosely in the hole 13*a* in the sliding block 6, although the fits can be reversed.

Figure 13:
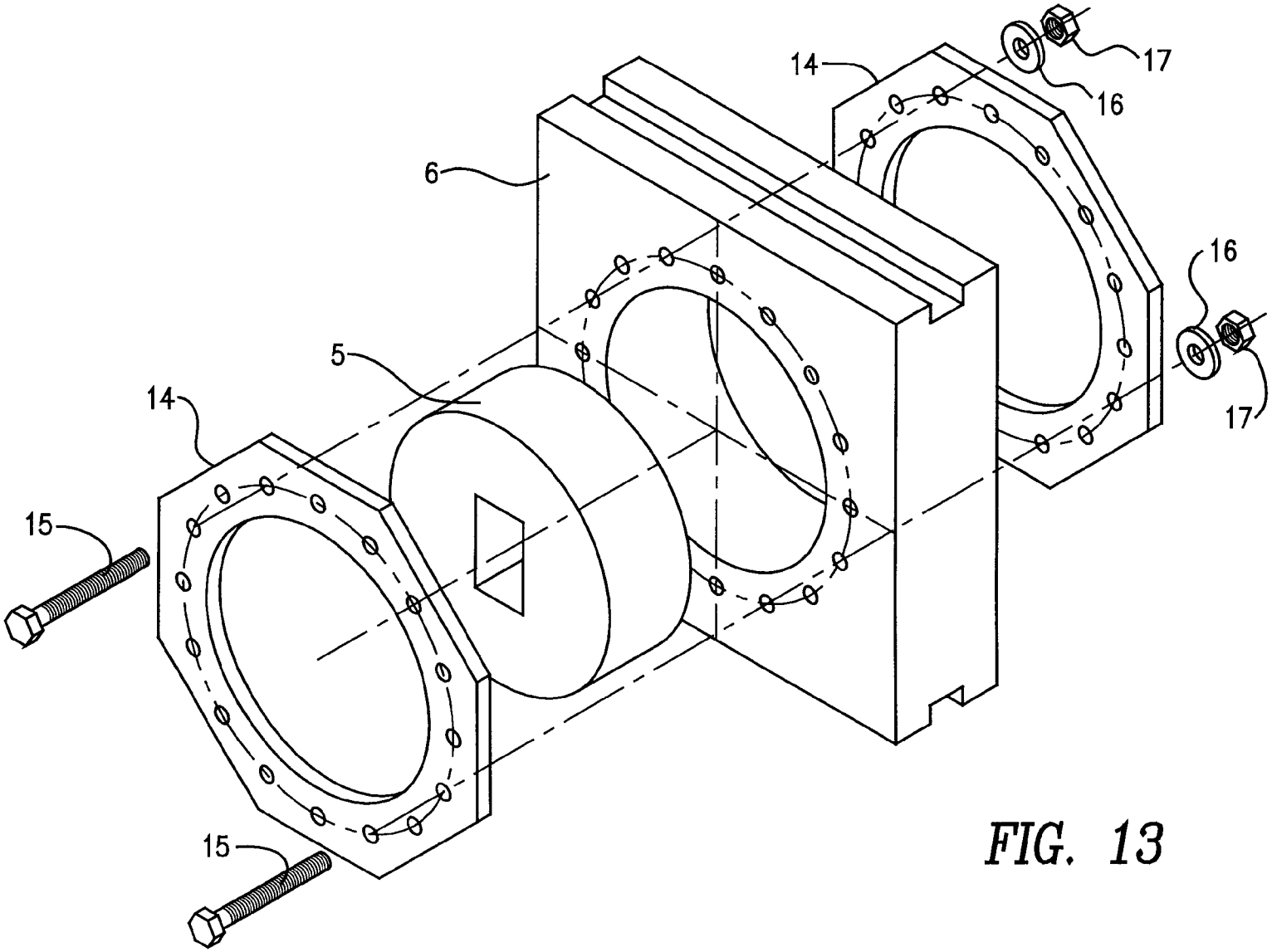
FIG. 13 is an exploded pictorial view of the externally cylindrical socket 5 and the internally cylindrical sliding block 6 of the invention.

The exploded assembly view of FIG. 13 shows the assembly of the externally cylindrical rotating socket 5 into the sliding block 6 with the flanges 14 and fastening bolts 15, washers 16 and nuts 17, for certain embodiments of the invention.

Figure 14:
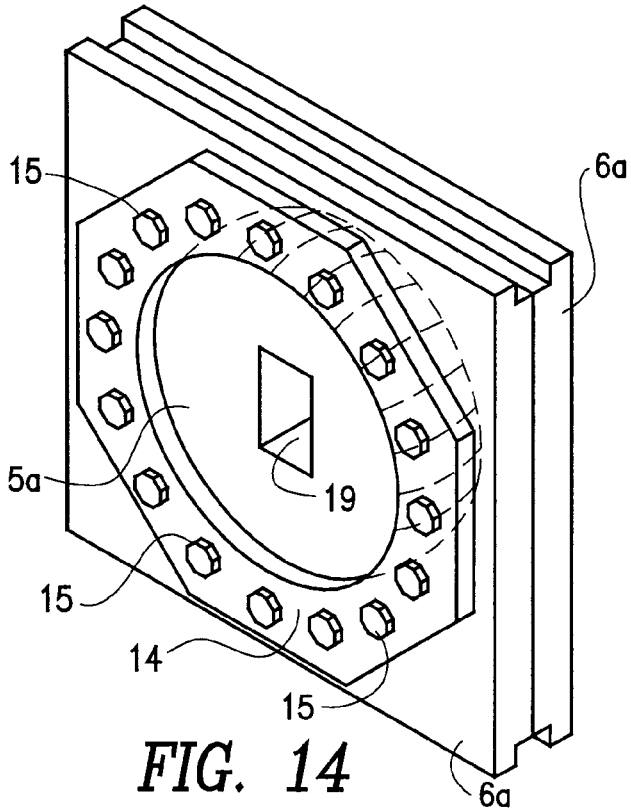
FIG. 14 shows a pictorial view of the assembly of the rotating socket 5*a* within the two halves of the sliding block 6*a* with flanges 14 and connecting bolts 15.

FIG. 14 shows the entrapment of a truncated externally spherical rotating socket 5*a* within the internally spherical sliding block 6*a*, composed of two halves for assembly, with flanges 14 added to the sides of the sliding block 6*a* to restrain the lateral rotating motion of the truncated externally spherical rotating socket 5*a*, by means of contact at said truncated faces, for another embodiment of the invention. The halves of the sliding block 6*a* and the flanges 14 are secured in assembly by means of bolts 15, washers 16 and nuts 17 (see FIG. 13).

Figure 15:
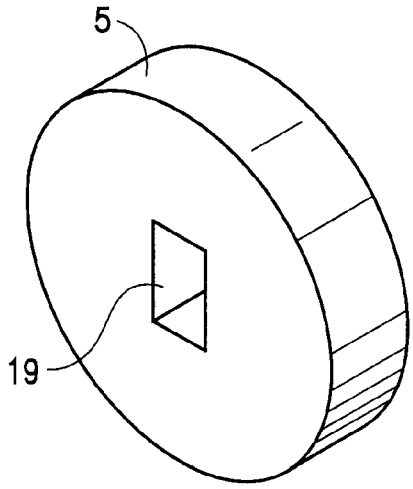
FIG. 15 shows a pictorial view of the details of the externally cylindrical rotating socket 5.
Figure 16:
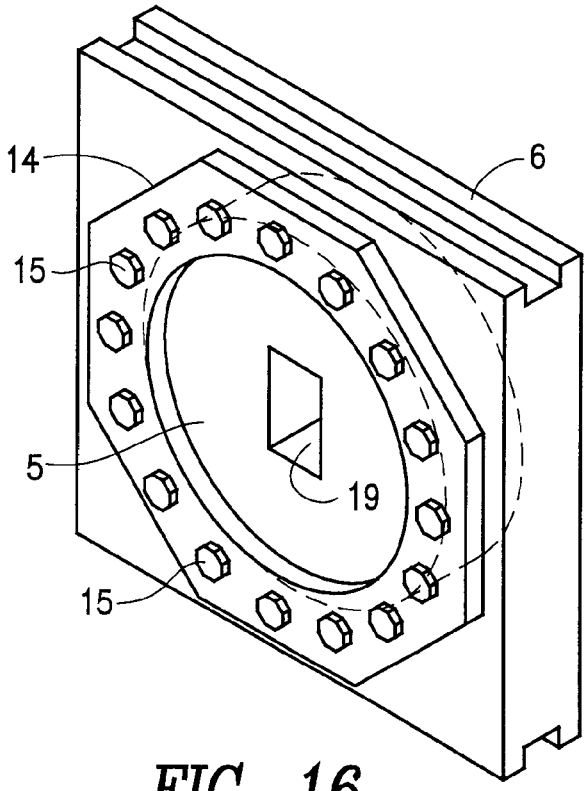
FIG. 16 shows a pictorial view of the details of the assembly of rotating socket 5, internally cylindrical sliding block 6, with an attached flange 14, and connecting bolts 15.

FIG. 15 shows a pictorial view of the externally cylindrical rotating socket 5. FIG. 16 shows a pictorial detail view of the assembly of rotating socket 5, and internally cylindrical sliding block 6. The sliding block 6 in FIG. 16 has the flanges 14 attached to prevent lateral movement of the externally cylindrical rotating socket 5. The flanges 14 are attached to sliding block 6 by means of bolts 15, washers 16, and nuts 17 (see FIG. 13).

Figure 17:
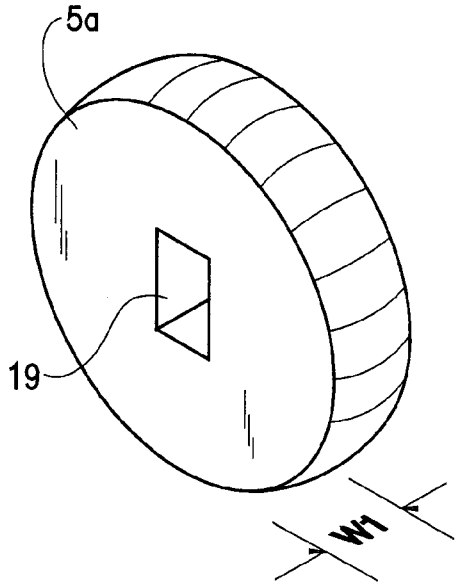
FIG. 17 shows a pictorial view of the details of the truncated externally spherical rotating socket 5*a*.
Figure 17A:
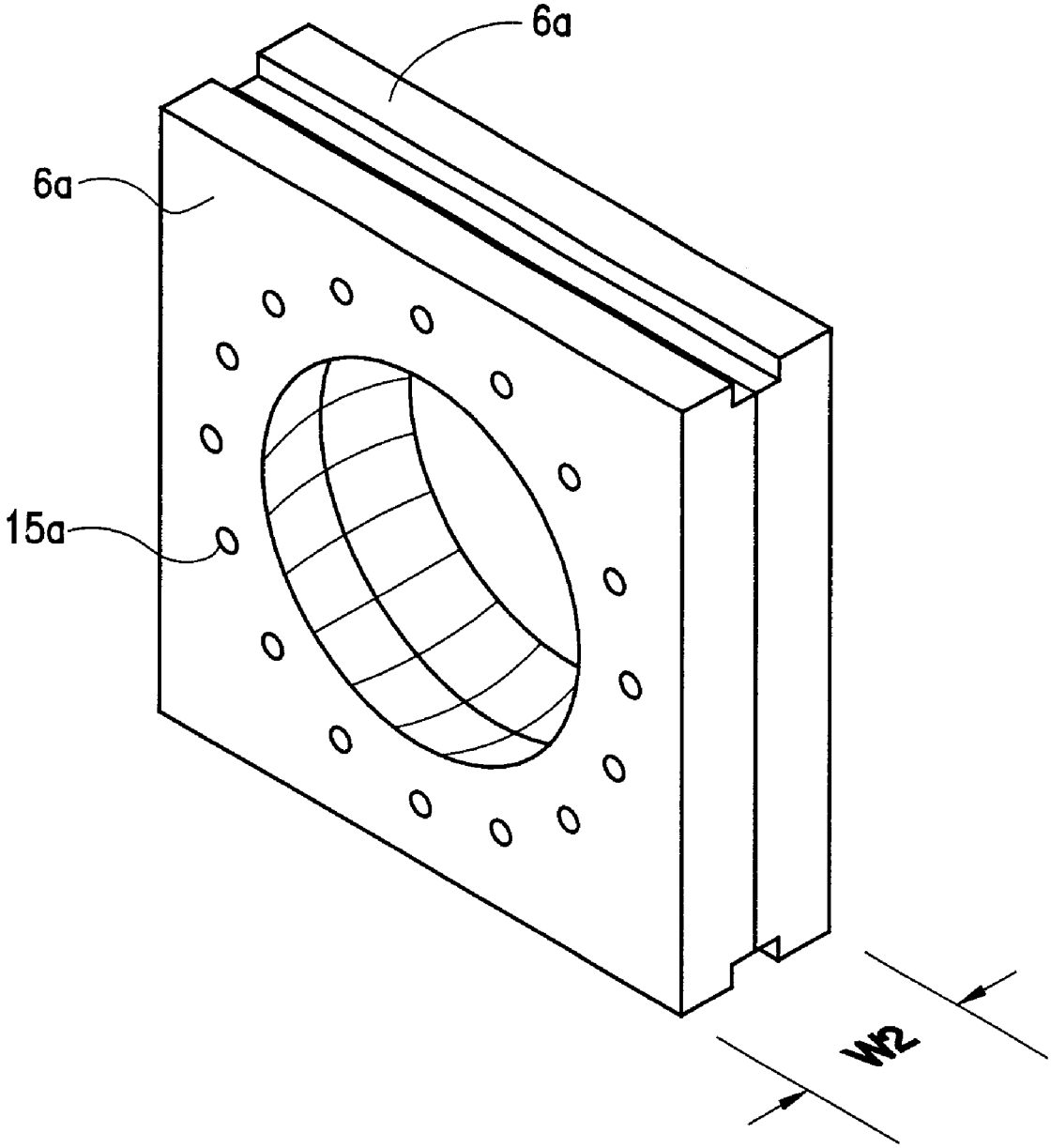
FIG. 17A shows a pictorial view of the truncated internally spherical sliding block 6*a* with its two halves in contact.
Figure 18:
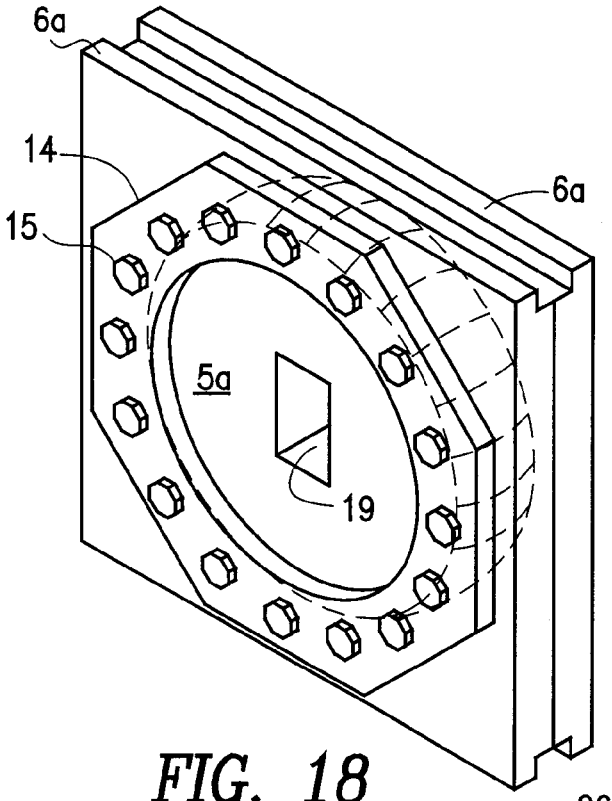
FIG. 18 shows a pictorial view of the assembly of rotating socket 5*a* within the sliding block 6*a*, with attached flanges 14, and connecting bolts 15.

FIG. 17 shows the truncated externally spherical rotating socket 5*a*, for another embodiment of the invention. The width W2 of the sliding block 6*a* as shown in FIG. 17A is slightly larger than the width W1 of the rotating socket 5*a* so that slight misalignment between the near leaf 1 and the far leaf 2 can be accommodated. The assembly of sliding block 6*a* with rotating socket 5*a*, flanges 14 (one being shown), and bolts 15 is shown in FIG. 18, with washers 16 and nuts 17 hidden from view (see FIG. 13) is shown in FIG. 18.

Figure 19:
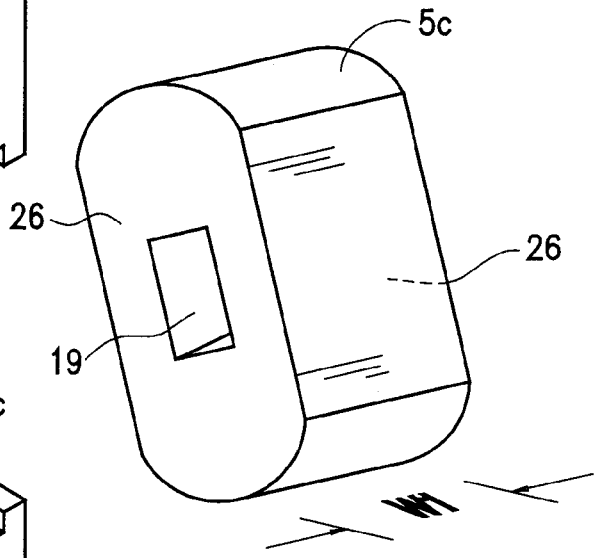
FIG. 19 shows a pictorial view of the details of the truncated externally cylindrical rotating socket 5*c*.
Figure 20:
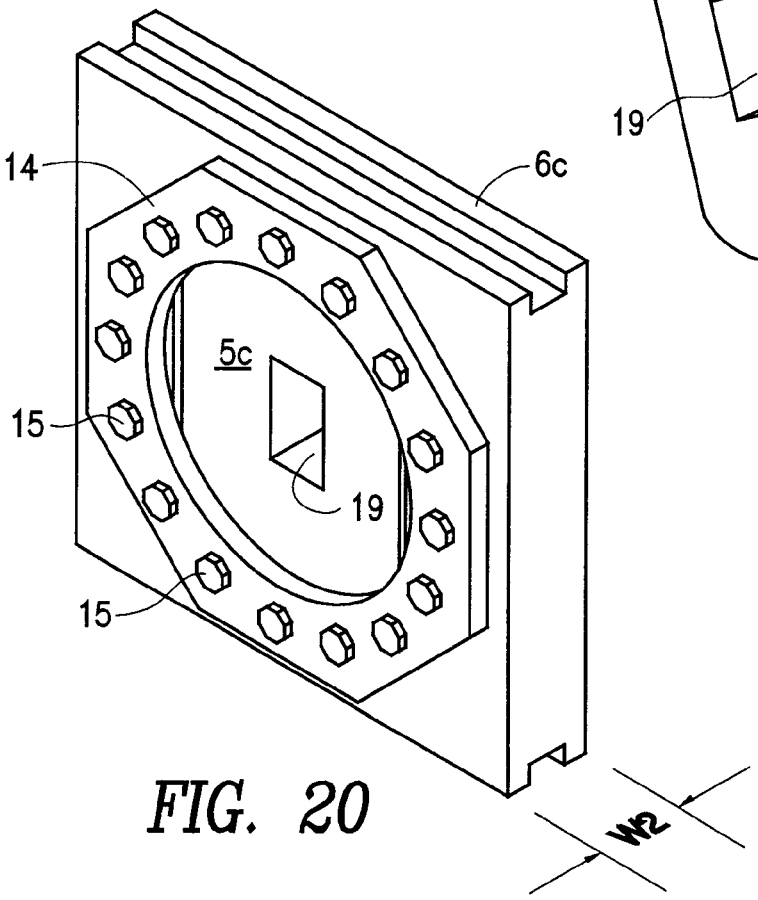
FIG. 20 shows a pictorial view of the assembly of the truncated externally cylindrical rotating socket 5*c*, truncated internally cylindrical sliding block 6*c*, with one attached flange 14, and connecting bolts 15.
Figure 19A:
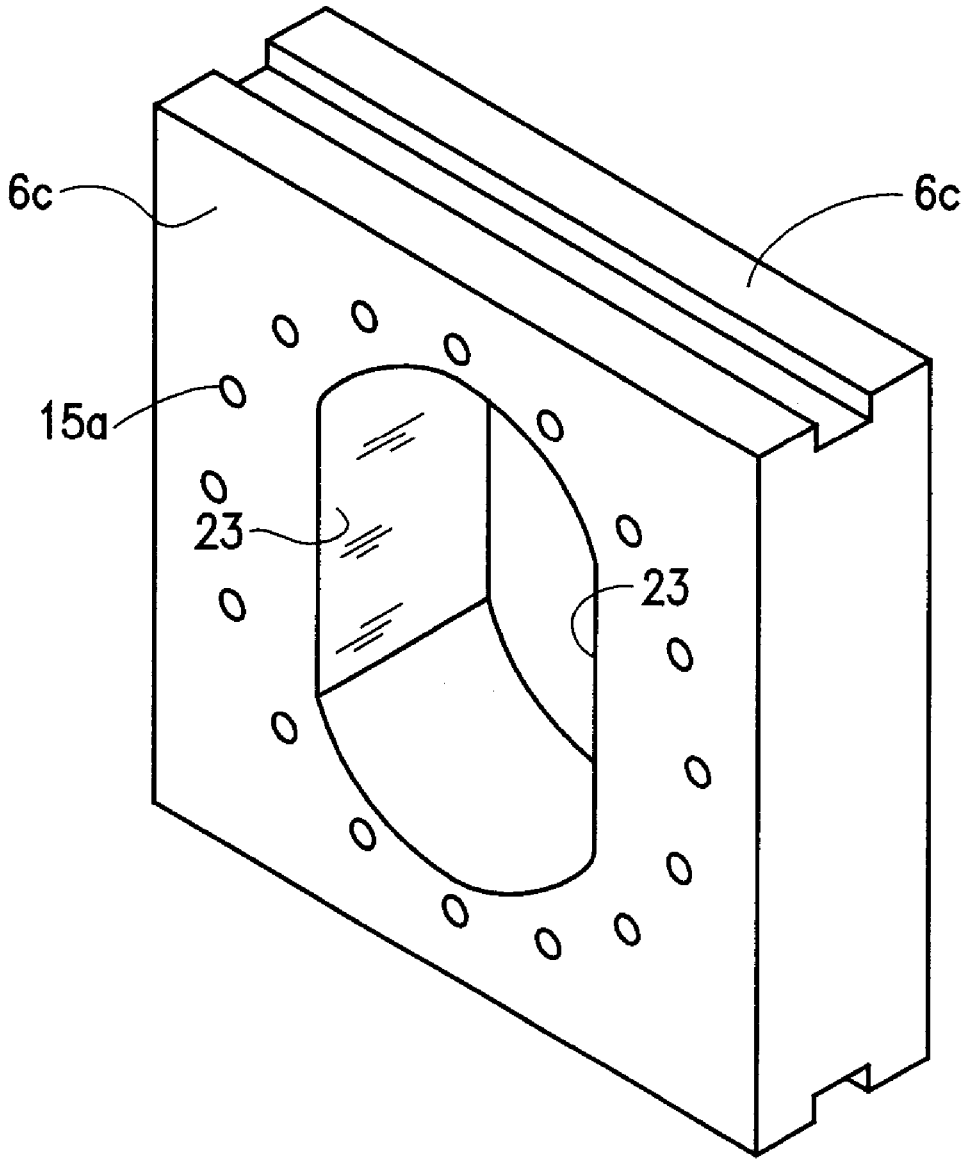
FIG. 19A shows a pictorial view of truncated internally cylindrical sliding block 6*c*.

The truncations 26, shown in FIG. 19, of the externally cylindrical rotating socket 5*c* prevent excessive rotation of the rotating socket 5*c* within the truncated internally cylindrical sliding block 6*c*, the truncations 23 of which are shown in detail in FIG. 19*a*, for yet another embodiment of the invention. FIG. 20 shows the assembly of these components with one flange 14 as shown, with bolts 15, washers 16 and nuts 17(see FIG. 13). The opposite side flange 14 is not being shown.

Figure 21:
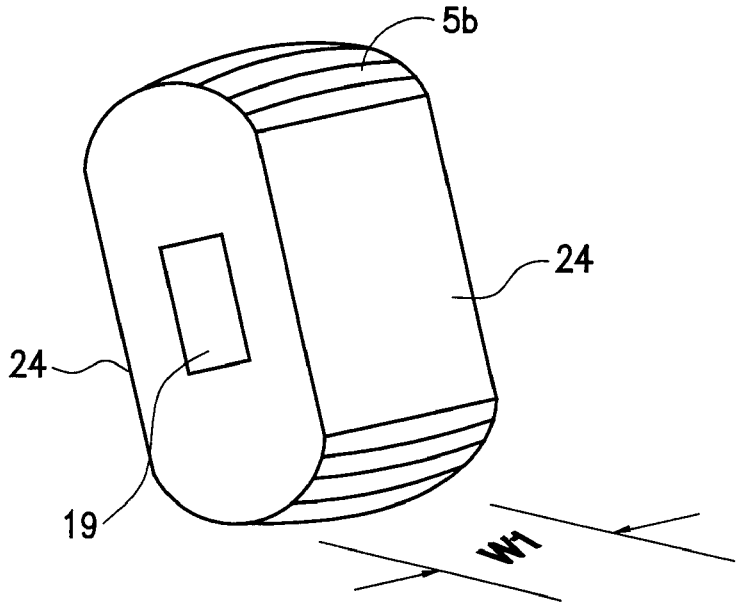
FIG. 21 shows a pictorial view of the details of the doubly truncated externally spherical rotating socket 5*b*.
Figure 22:
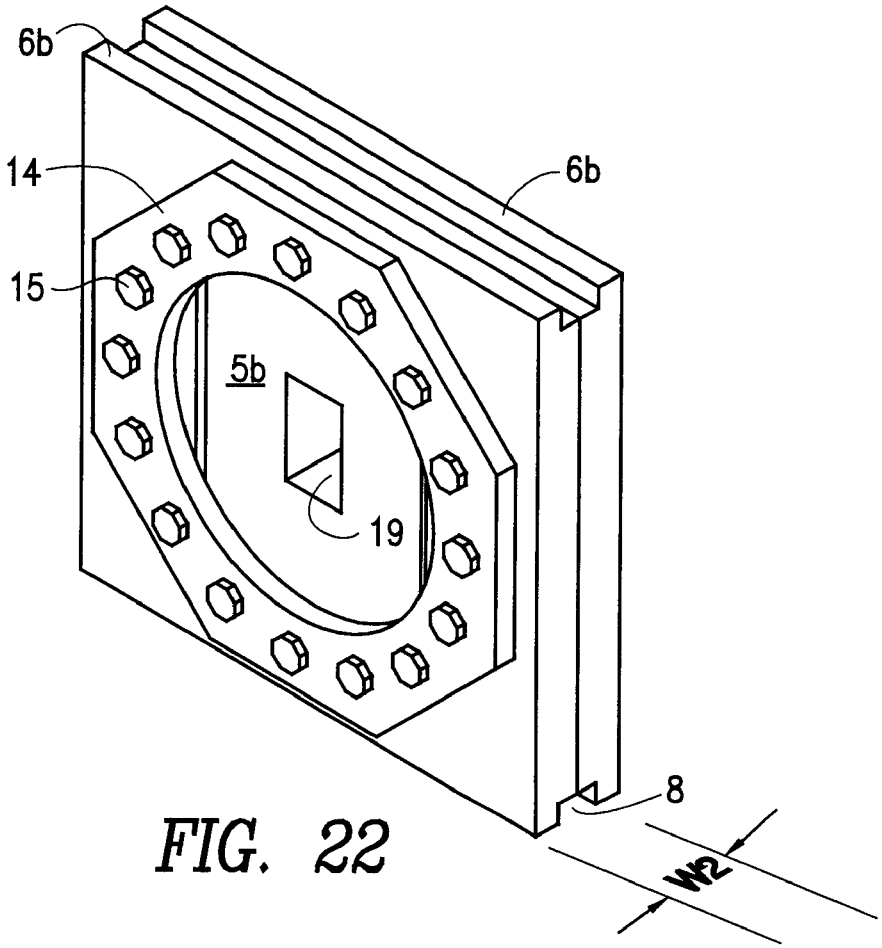
FIG. 22 shows a pictorial view of the assembly of the doubly truncated externally spherical rotating socket 5*b*, the truncated internally spherical sliding block 6*b*, with attached flange 14, and connecting bolts 15.
Figure 21A:
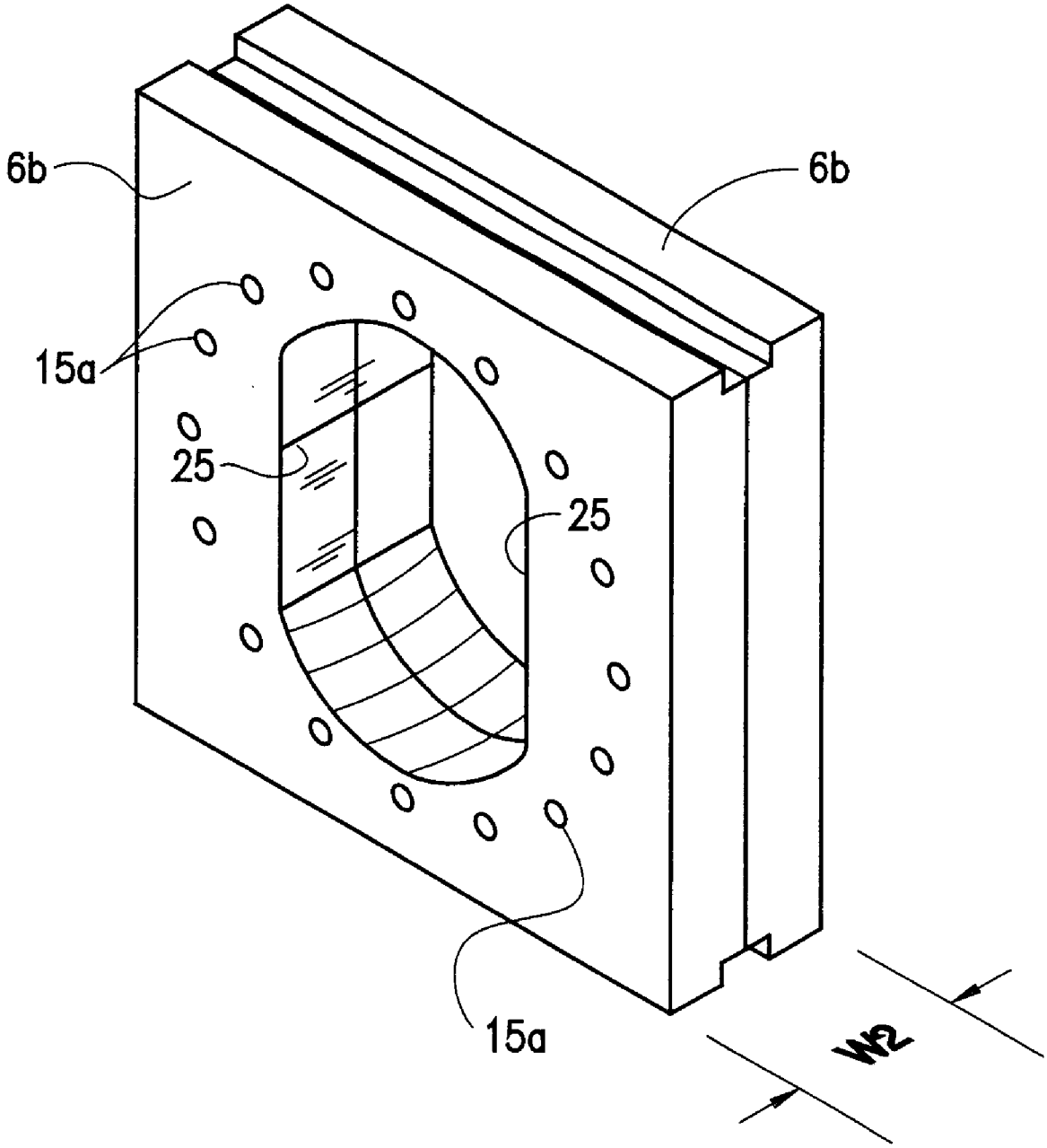
FIG. 21A shows a pictorial view of the internally spherical sliding block 6*b*.

FIG. 21 shows the details of the doubly truncated externally spherical rotating socket 5*b*, which mates with the truncated internally spherical sliding block 6*b* shown in FIG. 21A. Typically the sliding block 6*b* is split as shown in FIG. 21A to allow assembly around the rotating socket 5*b*, but with carefully proportioned components it will be possible in some cases to assemble the rotating socket 5*b* into the solid sliding block 6*b*. FIG. 22 shows the assembly of these components. The assembled components, as shown in FIG. 22, interact in such a way that the truncated faces 24 of the rotating socket 5*b* are restrained by similar opposing faces 25 on the interior of the sliding block 6*b* so as to prevent excessive rotation of the rotating socket 5*b*, thus preventing misalignment with the leading tapered portion 18 of the lockbar 9 (see FIG. 10) so that engagement may be made of the lockbar 9 into the hole 19 in the rotating socket 5*b* without interference, for another embodiment of the invention. The width W2 of the sliding block 6*b* is slightly larger than the width W1 of the rotating socket 5*b* so that slight misalignment between the near leaf 1 and the far leaf 2 can be accommodated. If it is desired to mount the flanges 14 on the rotating socket 5, 5*a*, 5*b*, 5*c*, 5*d*, or 5*e*, rather than the corresponding sliding block, than the width W1 would be made slightly larger than W2.

Figure 23:
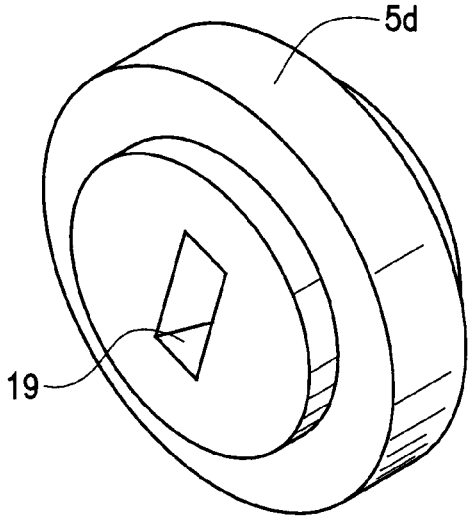
FIG. 23 shows a pictorial view of the details of the stepped externally cylindrical rotating socket 5*d*.
Figure 25:
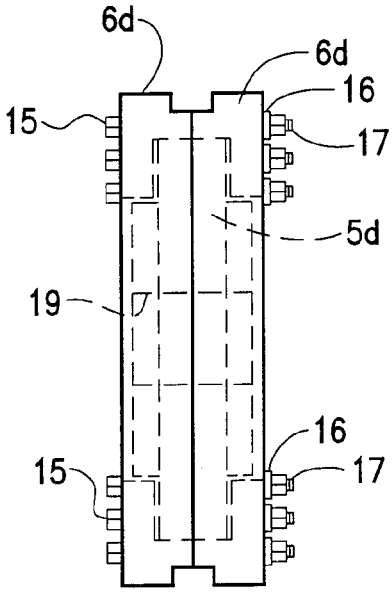
FIG. 25 shows an end elevational view of the assembly of the stepped externally cylindrical rotating socket 5*d* in the stepped internally cylindrical sliding block 6*d* with fastening bolts 15, washers 16 and nuts 17.
Figure 24:
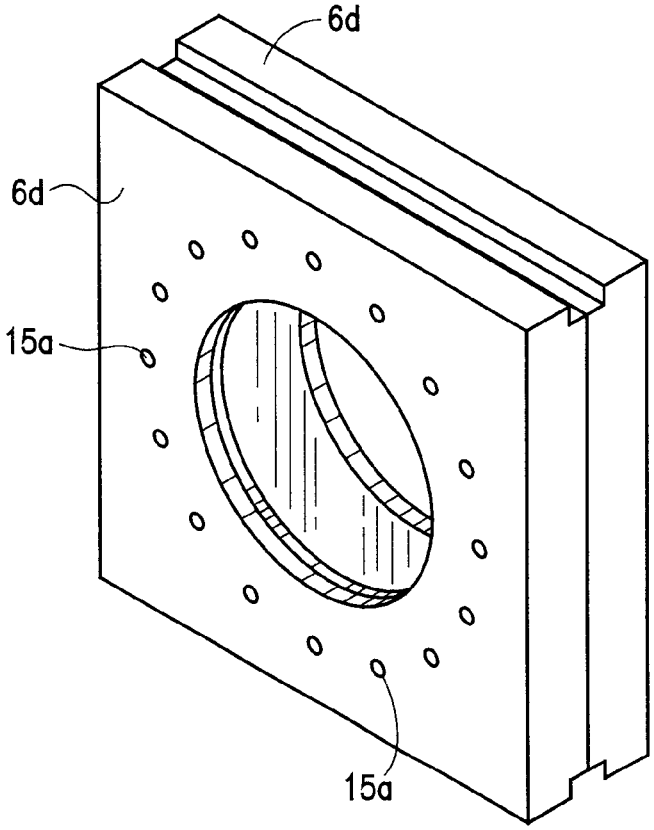
FIG. 24 shows a pictorial view of the details of the stepped internally cylindrical sliding block 6*d*.

FIG. 23 shows the external characteristics of a stepped externally cylindrical rotating socket 5*d* which mates with the stepped internally cylindrical sliding block 6*d* shown in FIG. 24, for another alternative embodiment of the invention. In this manner, the rotating socket 5*d* can turn in the sliding block 6*d*, but with translation of the rotating socket 5*d* being prevented along the collinear axes of the rotating socket 5*d* and the sliding block 6*d*, as shown in the end elevation view of FIG. 25.

Figure 28:
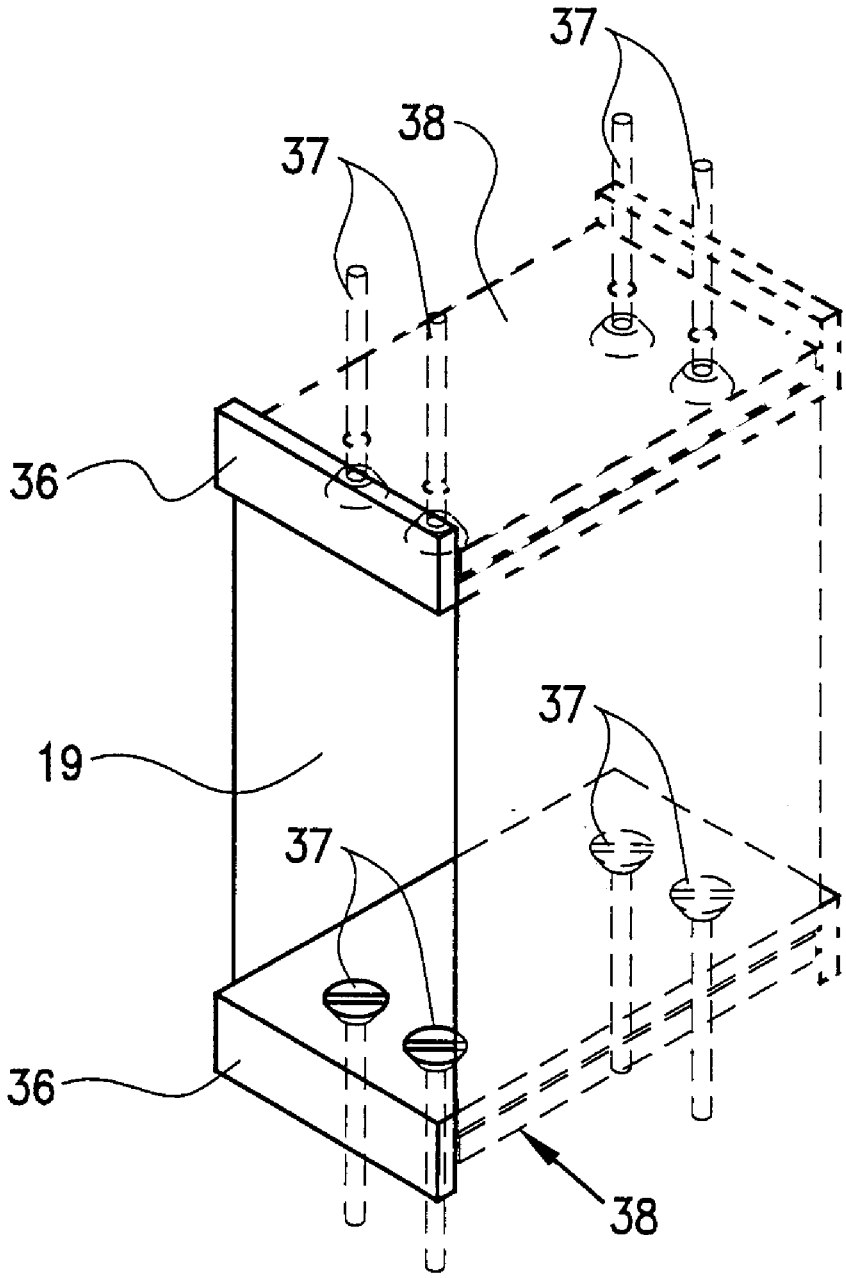
FIG. 28 shows a pictorial view of the hole 19 with optional adjustable contact plates or shoes 36 held in place by screws 37, with shims 38.

FIG. 28 shows an optional embodiment of hole 19 for any of the rotating sockets 5, 5*a*, 5*b*, 5*c*, 5*d*, or 5*e*, with separate wearing surfaces on removable plates or shoes 36, the position of which relative to rotating socket 5, 5*a*, 5*b*, 5*c*, 5*d*, or 5*e* can be modified by selective installation of shims 38, held in place by screws, 37 with the plates or shoes 36.

The present invention, as disclosed, affects the shear connection of the two mating leaves 1 and 2 per FIG. 1, by making and breaking between the lockbar 9 and either of the rotating socket embodiments 5, 5*a*, 5*b*, 5*c*, 5*d* or 5*e*, respectively, a rigid connection which is provided that does not directly accommodate deflections due to live load and thermal stresses. The invention which is hereby disclosed provides a permanent center lock bearing per FIG. 4 with rotating bearing surfaces to accommodate relative rotational deflections between near leaf 1 and far leaf 2 due to live load and temperature differences, via any one or combination of the alternative embodiments of rotating sockets 5, 5*a*, 5*b*, 5*c*, 5*d* or 5*e* which are never disengaged from the internal bearing surface of the associated sliding block 6, 6*a* (associated with 5*a*), 6*b*, 6*c*, 6*d* or 6*a* (associated with 5*e*), respectively. The external sliding bearing surfaces at either of the sliding blocks 6, 6*a*, 6*b*, 6*c*, 6*d* or 6*a* are never disengaged from the bearing surfaces of the respective guides 7, the combination of which directly accommodate longitudal deflections due to live load and thermal strains.

The most appropriate material for each component is determined by the particular application. Note that as the ability to resist the loads encountered in service is the primary criterion. Typically when all components consist of steel, the assembly will operate satisfactorily. Lubrication is important, and must be applied as a regular maintenance procedure to all moving parts. Substitution of other materials, such as bronze, Teflon, or other modern materials, may reduce the need for regular maintenance of the invention in service.

Operation

When the movable bridge is in position blocking the navigation channel, carrying traffic crossing over the bridge, the center locks are in the engaged position, forming a shear connection at each mating pair of trusses or girders 4 at main bridge leaves 1 and 2 per FIG. 1, with each lock bar 9 mating intimately with its associated guides 11 and 12 and a rotating socket 5, 5*a*, 5*b*, 5*c*, 5*d* or 5*e* per FIGS. 3 and 4. As the bridge leaves 1,2 deflect due to the application of live load such as a motor vehicle, rotational deflection of the ends of the two bridge leaves 1 and 2 per FIG. 2 is accommodated by the lock device described. This accommodation is made by means of rotation of the utilized ones of the rotating sockets 5, 5*a*, 5*b*, 5*c*, 5*d* or 5*e* within the associated sliding block 6, 6*a*, 6*b*, 6*c*, 6*d*, or 6*a*, respectively per FIG. 4. As the socket 5, 5*a*, 5*b*, 5*c*, 5*d* or 5*e* rotates with the lock bar 9 at the end or toe 21 of the near leaf 1 to which the lock bar 9 is attached per either of FIGS. 5, 6, 7, 8 or 9, and the sliding block 6, 6*a*, 6*b*, 6*c* or 6*d* rotates with end or toe 21 of the far leaf 2 to which a selected one of the sliding blocks 6, 6*a*, 6*b*, 6*c* or 6*d*, respectively, is attached, via the guides 7 per FIG. 4. The amount of relative rotation is equal to the absolute sum of the degree of angular deflection of the ends of the two leaves 1 and 2 per FIG. 1 under the live load. In addition to rotational deflections, the ends or toes 21 of the two leaves 1 and 2 come closer together and further apart as the live loads are applied and released and as temperature increases and decreases; the amount of this movement being determined by the geometry and rigidity of the leaves 1 and 2 of the movable bridge, by the amount of live load applied, and by the amount of temperature change causing thermal expansion or contraction of the bridge components. Temperature changes alone can also cause angular deflection of the ends or toes 21 of the leaves 1 and 2, with results similar to those experienced because of live load deflection or the combination of live load and temperature change. The relative longitudinal motion is taken up by the movement of the associated utilized ones of sliding blocks 6, 6*a*, 6*b*, 6*c* or 6*d* within its guides 7 on the bridge truss or girder 4 upon which it is mounted per FIG. 4.

The construction of each double leaf movable bridge and the conditions upon which it operates and carries traffic will allow the center lock proportions and material properties required for the particular application to be determined by application of standard engineering practice and references, such as those published by the American Association of State Highway and Transportation Officials for highway bridges, and the American Railway Engineering and Maintenance of Way Association for railway bridges. The amount of free longitudinal movement of the utilized one of sliding blocks 6, 6*a*, 6*b*, 6*c* or 6*d* along the guides 7 per FIG. 4, and free rotational movement of the rotating sockets 5, 5*a*, 5*b*, 5*c*, 5*d* or 5*e* within the mating sliding blocks 6, 6*a*, 6*b*, 6*c* or 6*d*, per FIGS. 5, 6, 7, 8, 9, or 9A, respectively, should be the minimums necessary for the application.

The leading end 18 of the lock bar 9 has a preferably rectilinear cross section and is fitted with tapered sides so that the lock bar 9 can be driven into the mating hole 19 in the associated rotating socket 5, 5*a*, 5*b*, 5*c*, 5*d* or 5*e* without initial interference. The pressure of the advancing tapered sides of the leading portion 18 of the lockbar 9 against the contacting sides of the hole 19 in the associated one of the rotating sockets 5, 5*a*, 5*b*, 5*c*, 5*d* or 5*e* produces torsional moments on the associated rotating socket 5, 5*a*, 5*b*, 5*c*, 5*d* or 5*e*, aligning the hole 19 in the associated rotating socket 5, 5*a*, 5*b*, 5*c*, 5*d* or 5*e* with the lockbar 9 by rotating the associated socket 5, 5*a*, 5*b*, 5*c*, 5*d* or 5*e* within the respective sliding block 6, 6*a*, 6*b*, 6*c* or 6*d*. In this manner lateral forces are developed against the sides of the tapered leading portion 18 of the lockbar 9 as it continues to enter the mating hole 19 in the associated rotating socket 5, 5*a*, 5*b*, 5*c*, 5*d* or 5*e*, forcing movement of the associated sliding block 6, 6*a*, 6*b*, 6*c* or 6*d*, via the associated rotating socket 5, 5*a*, 5*b*, 5*c*, 5*d* or 5*e*, along the guides 7 (see FIGS. 4, 7A and 8A) so that axial alignment of the lockbar 9 and the associated rotating socket 5, 5*a*, 5*b*, 5*c*, 5*d* or 5*e* is attained, regardless of the initial position or orientation of the associated rotating socket 5, 5*a*, 5*b*, 5*c*, 5*d* or 5*e* within the mating sliding block 6, 6*a*, 6*b*, 6*c* or 6*d*, or of the position of the sliding block 6, 6*a*, 6*b*, 6*c* or 6*d*, within the guides 7. In other words, after the tapered leading portion 18 of the lock bar 9 has entered the mating hole 19 in the associated rotating socket 5, 5*a*, 5*b*, 5*c*, 5*d* or 5*e*, further extension of the lock bar 9 causes the associated rotating socket 5, 5*a*, 5*b*, 5*c*, 5*d* or 5*e* to align itself with the lock bar 9, by rotating socket 5, 5*a*, 5*b*, 5*c*, 5*d* or 5*e* within mating sliding block 6, 6*a*, 6*b*, 6*c* or 6*d*, and causes the combination of rotating socket 5, 5*a*, 5*b*, 5*c*, 5*d* or 5*e* and mating sliding block 6, 6*a*, 6*b*, 6*c* or 6*d* to translate longitudinally along the guide 7 and come into alignment with the lock bar 9, as shown in FIG. 10. When the lock bar 9 is fully driven, the mating hole 19 in the rotating socket 5, 5*a*, 5*b*, 5*c*, 5*d* or 5*e* is fully in contact with the prismatic section of the lockbar 9, with no freedom of rotational, longitudinal or vertical movement between the lock bar 9 and rotating socket 5, 5*a*, 5*b*, 5*c*, 5*d* or 5*e* per FIGS. 5, 6, 7, 8, and 9 beyond those clearances desired to allow the required freedom of movement between mated bridge leaves 1 and 2.

The optional pin 13 (see FIG. 12) can be inserted radially through the hole 13*a* in the sliding block 6 and into the hole 13*b* in the rotating socket 5, or optionally one of the holes 13*a* in the sliding block embodiments 6*a*, 6*b*, 6*c* or 6*d*, into the hole 13*b* in the associated rotating socket 5*a*, 5*b*, 5*c*, 5*d* or 5*e*, so that motion of the associated rotating socket 5, 5*a*, 5*c*, 5*d* or 5*e*, respectively, is further limited relative to sliding block 6, 6*a*, 6*b*, 6*c* or 6*d*, respectively, eliminating the likelihood ofjamming as the lockbar 9 is inserted into the rotating socket 5, 5*a*, 5*b*, 5*c*, 5*d* or 5*e*. The pin 13 is loosely fitted to the hole 13*a* in the associated sliding block 6, 6*a*, 6*b*, 6*c* or 6*d* and tightly fitted to the hole 13*b* in the associated rotating socket 5, 5*a*, 5*b*, 5*c*, 5*d* or 5*e*. Alternatively the pin 13 is loosely fitted to the hole 13*b* in the associated rotating socket 5, 5*a*, 5*b*, 5*c*, 5*d* or 5*e* and tightly fitted to the hole 13*a* in the associated sliding block 6, 6*a*, 6*b*, 6*c* or 6*d*. Additional fixity of pin 13 in tightly fitting hole 13*a* can be accomplished by means of optional screw or key 40 not shown.

To allow the bridge to be opened for marine traffic, the lock bars 9 are withdrawn by means of the thrusting mechanism or mechanisms 10 (see FIG. 5), to the position relative to rotating socket 5, 5*a*, 5*b*, 5*c*, 5*d* or 5*e* and sliding block 6, 6*a*, 6*b*, 6*c*, or 6*d* shown in FIG. 11, and the bridge can be opened. After the bridge has opened and the marine vessel has passed through the navigation channel, the leaves 1 and 2 of the bridge are returned to the closed position, contacting live load bearing 8. The thrusting mechanisms 10 are then actuated extending the lock bars 9 to full engagement with the associated rotating sockets 5, 5*a*, 5*b*, 5*c*, 5*d* or 5*e* as shown in FIG. 10. After any additional safety devices not part of this invention are placed in their proper positions, the bridge is ready to carry traffic.

Although various embodiments of the invention have been shown and described, they are not meant to be limiting. Those of skill in the art may recognize various modifications to those embodiments, which are meant to be covered by the spirit and scope of the appended claims.

What I claim is:

1. In a movable bridge, supported upon piers, comprising a pair of opposed leaf sections each movable to an open position or to a closed position, respectively, and each further comprising a deck supported in combination by main bridge support members, bearings upon which said movable bridge is mounted on said piers, and live load bearings which contact said movable bridge when in position to carry traffic, the improvement comprising:

at least one pair of center locks mounted between said pair of opposed leaf sections for transferring the live load shear from one leaf section to the other, each center lock of said at least one pair of center locks including:

a sliding block mounted on one of said pair of opposed leaf sections, said sliding block being adapted for sliding horizontally;

a unitary socket member retained within said sliding block, said socket member having a throughhole extending therethrough;

a lock bar slidably mounted on the other one of said pair of leaf sections and oriented parallel to the transverse axis of the bridge, said lock bar being adapted for reversibly sliding through the throughhole of said socket member; and thrusting means in operative engagement with the lock bar for reversibly thrusting the lock bar through the throughhole of the socket member when the pair of opposed leaf sections are in the closed position, said lock bar in its coupled position being wholly surrounded by the throughhole of its associated said socket member, wherein each of the at least one pair of center locks provides separate accommodation of engagement and deflection of the leaf sections respectively.

2. The movable bridge of claim 1, wherein the lock bar includes a non-circular cross section mounted on the main bridge support members of the other one of said pair of leaf sections, which fits closely into the throughhole of the socket member mounted on the opposing leaf section.

3. The movable bridge of claim 1, wherein said socket member includes a partial or wholly disc-shaped external configuration, which fits rotatably into said sliding block.

4. The movable bridge of claim 3, wherein said sliding block is mounted on a guide fixed to said one of said pair of leaf sections, so that the sliding block can translate freely in the longitudinal direction.

5. The movable bridge of claim 1, wherein said lock bar includes an approximately rectangular cross section.

6. The movable bridge of claim 3, wherein the rotation of said socket member is limited to an axis parallel to the axes of rotation of the bridge leaf sections.

7. The movable bridge of claim 3, wherein the rotation of said socket member is limited to an axis perpendicular to the major plane of the main bridge support members and parallel to the axes of rotation of the bridge leaf sections.

8. The movable bridge of claim 3, wherein the rotation of said socket member is limited to a horizontal axis perpendicular to the major plane of the main bridge support members.

9. The movable bridge of claim 3, wherein the motion of said socket member within said sliding block is limited.

10. The movable bridge of claim 9, wherein the relative rotational movement of said socket member within said sliding block is limited by a radially oriented pin mounted therebetween, and mating tightly with the socket member and loosely with the said sliding block.

11. The movable bridge of claim 9, wherein the external surfaces of said socket member and the internal surfaces of said sliding block are cylindrical, and the relative motion between said socket member, and said sliding block is limited by truncation of the cylindrical shape of the external surface of the socket member and internal surface of the sliding block.

12. The movable bridge of claim 9, wherein both the external surface of said socket member and the internal surface of said sliding block are spherical, and the relative motion between said socket member and said sliding block is limited by truncation of the spherical shape of the external surface of the socket and internal surface of the associated sliding block.

13. The movable bridge of claim 3, wherein motion of said socket member, parallel to the motion of said lock bar, during engagement or disengagement, is prevented by stepping of the diameter of said socket member, and by corresponding changes in the diameter of mating surfaces of said sliding block.

14. The movable bridge of claim 3, wherein lateral motion of said socket member individually mounted in said sliding block, parallel to the motion of said lock bar during engagement or disengagement, respectively, is prevented by a pair of flanges each mounted on opposing sides of said sliding block.

15. The movable bridge of claim 4, wherein lateral motion of said socket member mounted in said sliding block, parallel to the motion of said lock bar during engagement or disengagement, respectively, is prevented by a pair of flanges each mounted on opposing sides of said sliding block.

16. The movable bridge of claim 4, wherein the movement of said sliding block within said guide is limited.

17. The movable bridge of claim 12, in which the socket member and associated sliding block do not resist the rotation of the main bridge support members in axes parallel to the main axis of the bridge.

18. The movable bridge of claim 12, in which the rotational movement of said socket member within said sliding block is limited to one rotational direction by a pair of flanges, each flange being mounted on an opposing side of said sliding block.

19. The movable bridge of claim 3, in which the rotational movement of said socket member is limited by truncations.

20. The movable bridge of claim 3, wherein the rotational movement of said socket member is limited by a bolt extending through an oversized hole in said socket member and fixed to said sliding block.

21. The movable bridge of claim 18, wherein the rotational movement of said socket member is limited by a bolt extending through an oversized hole in said socket member and fixed to said flanges in said sliding block.

22. The movable bridge of claim 3 in which said sliding block comprises a two piece assembly.

23. The movable bridge of claim 2, wherein the fit between the lock bar and the throughhole in the socket member is adjustable.

24. In a movable bridge, supported upon piers, comprising a pair of opposed leaf sections each movable to an open position or to a closed position, respectively, and each further comprising a deck supported in combination by main bridge support members, bearings upon which said movable bridge is mounted on said piers, and live load bearings which contact said movable bridge when in position to carry traffic, the improvement comprising:

at least one pair of center locks mounted normal to the plane of the main bridge support members of the movable bridge between the pair of opposed leaf sections for transferring the live load shear from one leaf section to the other, each center lock of said at least one pair of centers lock including:

a sliding block mounted on one of said pair of opposed leaf sections, said sliding block being adapted for sliding horizontally;

a unitary socket member retained within said sliding block, said socket member having a throughhole extending therethrough;

a lock bar slidably mounted on the other one of the pair of opposed leaf sections and oriented parallel to the transverse axis of the bridge, said lock bar being adapted for reversibly sliding through the throughhole of said socket member; and thrusting means in operative engagement with the lock bar for reversibly thrusting the lock bar through the throughhole of the socket member when the pair of opposed leaf sections are in the closed position, said lock bar in its coupled position being wholly surrounded by the throughhole of its associated said socket member, wherein each of the at least one pair of center locks provides separate accommodation of engagement and deflection of the leaf sections.

25. In a movable bridge, supported upon piers, comprising a pair of opposed leaf sections each movable to an open position or to a closed position, respectively, and each further comprising: a deck supported in combination by main bridge support members, bearings upon which said movable bridge is mounted on said piers, and live load bearings which contact said movable bridge when in position to carry traffic, the improvement comprising:

at least one pair of center locks mounted to the main bridge support members of the movable bridge on a horizontal axis normal to the main axis of the movable bridge, between the pair of opposed leaf sections for transferring the live load shear from one leaf section to the other, each center lock of said at least one pair center locks including:

a sliding block mounted on one of said pair of opposed leaf sections, said sliding block being adapted for sliding horizontally;

a unitary socket member retained within said sliding block, said socket member having a throughhole extending therethrough;

a lock bar slidably mounted on the other one of the pair of opposed leaf sections and oriented parallel to the transverse axis of the bridge, said lock bar being adapted for reversibly sliding through the throughhole of said socket member; and thrusting means in operative engagement with the lock bar for reversibly thrusting the lock bar through the throughhole of the socket member when the pair of opposed leaf sections are in the closed position, said lock bar in its coupled position being wholly surrounded by the throughhole of its associated said socket member, wherein each of the at least one pair of center locks provides separate accommodation of engagement and deflection of the leaf sections.

26. In a movable bridge, supported upon piers, comprising a pair of opposed leaf sections each movable to an open position or to a closed position, respectively, and each further comprising a deck supported in combination by main bridge support members, bearings upon which said movable bridge is mounted on said piers, and live load bearings which contact said movable bridge when in position to carry traffic, the improvement comprising:

at least one pair of center locks mounted between said pair of opposed leaf sections for transferring the live load shear from one leaf section to the other, each center lock of said at least one pair of center locks including:

a unitary socket member mounted on one of said pair of leaf sections, said socket member having a throughhole extending therethrough;

horizontally sliding means for retaining and providing the mounting of said unitary socket member, said sliding means being adapted for moving longitudinally within a range;

a lock bar slidably mounted on the other one of said pair of leaf sections and oriented parallel to the transverse axis of the bridge, said lock bar being adapted for reversibly sliding through the throughhole of said socket member; and thrusting means in operative engagement with the lock bar for reversibly thrusting the lock bar through the throughhole of the socket member when the pair of opposed leaf sections are in the closed position, said lock bar in its coupled position being wholly surrounded by the throughhole of its associated said socket member, wherein each of the at least one pair of center locks provides separate accommodation of engagement and deflection of the leaf sections.

27. The movable bridge of claim 26, wherein the lock bar includes a non-circular cross section mounted on the main bridge support members of the other one of said pair of leaf sections, which fits closely into the throughhole of the socket member mounted on the opposing leaf section.

28. The movable bridge of claim 26, wherein said socket member includes a partial or wholly disc-shaped external configuration, which fits rotatably into said sliding means.

29. The movable bridge of claim 28, wherein said sliding means is mounted on a guide fixed to said one of said pair of leaf sections, so that the sliding means can translate freely in the longitudinal direction.

30. The movable bridge of claim 26, wherein said lock bar includes an approximately rectangular cross section.

31. The movable bridge of claim 28, wherein the rotation of said socket member is limited to an axis parallel to the axes of rotation of the bridge leaf sections.

32. The movable bridge of claim 28, wherein the rotation of said socket member is limited to an axis perpendicular to the major plane of the main bridge support members and parallel to the axes of rotation of the bridge leaf sections.

33. The movable bridge of claim 28, wherein the rotation of said socket member is limited to a horizontal axis perpendicular to the major plane of the main bridge support members.

34. The movable bridge of claim 28, wherein the motion of said socket member within said sliding means is limited.

35. The movable bridge of claim 34, wherein the relative rotational movement of said socket member within said sliding means is limited by a radially oriented pin mounted therebetween, and mating tightly with the socket member and loosely with the said sliding means.

36. The movable bridge of claim 34, wherein the external surfaces of said socket member and the internal surfaces of said sliding means are cylindrical, and the relative motion between said socket member, and said sliding means is limited by truncation of the cylindrical shape of the external surface of the socket member and internal surface of the sliding block.

37. The movable bridge of claim 34, wherein both the external surface of said socket member and the internal surface of said sliding means are spherical, and the relative motion between said socket member and said sliding means is limited by truncation of the spherical shape of the external surface of the socket and internal surface of the associated sliding means.

38. The movable bridge of claim 28, wherein motion of said socket member, parallel to the motion of said lock bar, during engagement or disengagement, is prevented by stepping of the diameter of said socket member, and by corresponding changes in the diameter of mating surfaces of said sliding means.

39. The movable bridge of claim 28, wherein lateral motion of said socket member individually mounted in said sliding means, parallel to the motion of said lock bar during engagement or disengagement, respectively, is prevented by a pair of flanges each mounted on opposing sides of said sliding means.

40. The movable bridge of claim 29, wherein lateral motion of said socket member mounted in said sliding means, parallel to the motion of said lock bar during engagement or disengagement, respectively, is prevented by a pair of flanges each mounted on opposing sides of said sliding block.

41. The movable bridge of claim 29, wherein the movement of said sliding means within said guide is limited.

42. The movable bridge of claim 37, in which the socket member and associated sliding means do not resist the rotation of the main bridge support members in axes parallel to the main axis of the bridge.

43. The movable bridge of claim 37, in which the rotational movement of said socket member within said sliding means is limited to one rotational direction by a pair of flanges, each flange being mounted on an opposing side of said sliding block.

44. The movable bridge of claim 28, in which the rotational movement of said socket member is limited by truncations.

45. The movable bridge of claim 28, wherein the rotational movement of said socket member is limited by a bolt extending through an oversized hole in said socket member and fixed to said sliding means.

46. The movable bridge of claim 43, wherein the rotational movement of said socket member is limited by a bolt extending through an oversized hole in said socket member and fixed to said flanges in said sliding means.

47. The movable bridge of claim 3 in which said sliding means comprises a two piece assembly forming a sliding block.

48. The movable bridge of claim 27, wherein the fit between the lock bar and the throughhole in the socket member is adjustable.

49. In a movable bridge, supported upon piers, comprising a pair of opposed leaf sections each movable to an open position or to a closed position, respectively, and each further comprising a deck supported in combination by main bridge support members, bearings upon which said movable bridge is mounted on said piers, and live load bearings which contact said movable bridge when in position to carry traffic, the improvement comprising:

at least one pair of center locks mounted normal to the plane of the main bridge support members of the movable bridge between the pair of opposed leaf sections for transferring the live load shear from one leaf section to the other, each center lock of said at least one pair of centers lock including:

a unitary socket member mounted on one of the pair of opposed leaf sections, said socket member having a throughhole extending therethrough;

horizontally sliding means for retaining and providing the mounting of said unitary socket member, said sliding means being adapted for moving longitudinally within a range;

a lock bar slidably mounted on the other one of the pair of opposed leaf sections and oriented parallel to the transverse axis of the bridge, said lock bar being adapted for reversibly sliding through the throughhole of said socket member; and thrusting means in operative engagement with the lock bar for reversibly thrusting the lock bar through the throughhole of the socket member when the pair of opposed leaf sections are in the closed position, said lock bar in its coupled position being wholly surrounded by the throughhole of its associated said socket member, wherein each of the at least one pair of center locks provides separate accommodation of engagement and deflection of the leaf sections.

50. In a movable bridge, supported upon piers, comprising a pair of opposed leaf sections each movable to an open position or to a closed position, respectively, and each further comprising: a deck supported in combination by main bridge support members, bearings upon which said movable bridge is mounted on said piers, and live load bearings which contact said movable bridge when in position to carry traffic, the improvement comprising:

at least one pair of center locks mounted to the main bridge support members of the movable bridge on a horizontal axis normal to the main axis of the movable bridge, between the pair of opposed leaf sections for transferring the live load shear from one leaf section to the other, each center lock of said at least one pair center locks including:

a unitary socket member mounted on one of said pair of leaf sections, said socket member having a throughhole extending therethrough;

horizontally sliding means for retaining and providing the mounting of said unitary socket member, said sliding means being adapted for moving longitudinally within a range;

a lock bar slidably mounted on the other one of the pair of opposed leaf sections and oriented parallel to the transverse axis of the bridge, said lock bar being adapted for reversibly sliding through the throughhole of said socket member; and thrusting means in operative engagement with the lock bar for reversibly thrusting the lock bar through the throughhole of the socket member when the pair of opposed leaf sections are in the closed position, said lock bar in its coupled position being wholly surrounded by the throughhole of its associated said socket member, wherein each of the at least one pair of center locks provides separate accommodation of engagement and deflection of the leaf sections.

* * * * *